US010964166B2

(12) United States Patent
Sakamoto et al.

(10) Patent No.: US 10,964,166 B2
(45) Date of Patent: Mar. 30, 2021

(54) OPERATING DEVICE OF GAME MACHINE AND GAME MACHINE

(71) Applicant: JT CO.,LTD., Nagoya (JP)

(72) Inventors: Hidehiko Sakamoto, Nagoya (JP); Jong Hak Choi, Seoul (KR); Hideo Takeda, Tokyo (JP); Nobuyuki Matsutani, Tokyo (JP); Hiroaki Kashima, Tokyo (JP); Yuta Kikuchi, Tokyo (JP); Takashi Mega, Tokyo (JP); Akito Inoue, Tokyo (JP); Yoshinori Ogawa, Tokyo (JP); Yoshihisa Tanaka, Tokyo (JP); Yuki Hamamoto, Tokyo (JP); Rui Kaga, Tokyo (JP); Takaaki Hirama, Tokyo (JP); Noriyuki Ikarashi, Tokyo (JP)

(73) Assignee: JT CO., LTD., Nagoya (JP)

( * ) Notice: Subject to any disclaimer, the term of this patent is extended or adjusted under 35 U.S.C. 154(b) by 105 days.

(21) Appl. No.: 16/264,506

(22) Filed: Jan. 31, 2019

(65) Prior Publication Data

US 2020/0043292 A1 Feb. 6, 2020

(30) Foreign Application Priority Data

Aug. 3, 2018 (JP) ..... JP2018-146554

(51) Int. Cl.
*G07F 17/32* (2006.01)

(52) U.S. Cl.
CPC ..... *G07F 17/3267* (2013.01); *G07F 17/3213* (2013.01); *G07F 17/3244* (2013.01)

(58) Field of Classification Search
CPC ..... G07F 17/3267; G07F 17/3244; G07F 17/3213
See application file for complete search history.

(56) References Cited

U.S. PATENT DOCUMENTS 5,249,104 A * 9/1993 Mizobe ..... G02B 6/0018 362/327
5,271,628 A * 12/1993 Okada ..... A63F 9/30 221/210

(Continued)

FOREIGN PATENT DOCUMENTS

JP 2011-92719 A 5/2011

OTHER PUBLICATIONS

Applicant published a pamphlet entitled "Fortune Guardians" in 2018 for distributing at ICE Totally Gaming, Excel London (Royal Victoria Dock, 1 Western Gateway, London E16 1XL, UK) during Feb. 6 through 8, 2018 and at G2E Asia (G2E: Global Gaming Expo) Venetian Macau Convention & Exhibition Center (Estrada da Baia de Nossa Senhora da Esperanca, Macau) during May 15 through 17, 2018.

*Primary Examiner* — Kevin Y Kim
(74) *Attorney, Agent, or Firm* — Kenichiro Yoshida

(57) ABSTRACT

Disclosed is an operating device of a game machine which is installed in the game machine including a display portion which displays the progress of a game in accordance with a control of a body controller and a result of the game and operates the progress of the game in conjunction with a display on the display portion. This operating device includes a rotation operation portion capable of being rotated by a player, a rotation operation detecting portion which detects a state of rotation operation of the rotation operation portion, a decoration display portion which displays any one of a pattern, a symbol and a letter, or a combination thereof, and a connection portion which outputs a signal of the rotation operation detecting portion to the body controller and inputs a signal for controlling a display of the decoration display portion from the body controller.

40 Claims, 18 Drawing Sheets

(56) References Cited

U.S. PATENT DOCUMENTS

| | | | | |
|---|---|---|---|---|
| 5,292,127 | A * | 3/1994 | Kelly | G07F 17/32<br>273/118 A |
| 6,626,761 | B1 * | 9/2003 | Okada | G07F 17/3227<br>463/16 |
| 2005/0250574 | A1 * | 11/2005 | Kane | G07F 17/329<br>463/17 |
| 2006/0009278 | A1 * | 1/2006 | Vancura | G07F 17/3267<br>463/25 |
| 2007/0054723 | A1 * | 3/2007 | Mattice | G07F 17/3211<br>463/16 |
| 2008/0176619 | A1 * | 7/2008 | Kelly | G07F 17/3244<br>463/16 |
| 2009/0325684 | A1 * | 12/2009 | Wudtke | G07F 17/32<br>463/21 |
| 2018/0075691 | A1 * | 3/2018 | Sumi | G07F 17/3209 |
| 2019/0122493 | A1 * | 4/2019 | Ikeda | G07F 17/3244 |

* cited by examiner

FIG. 5A
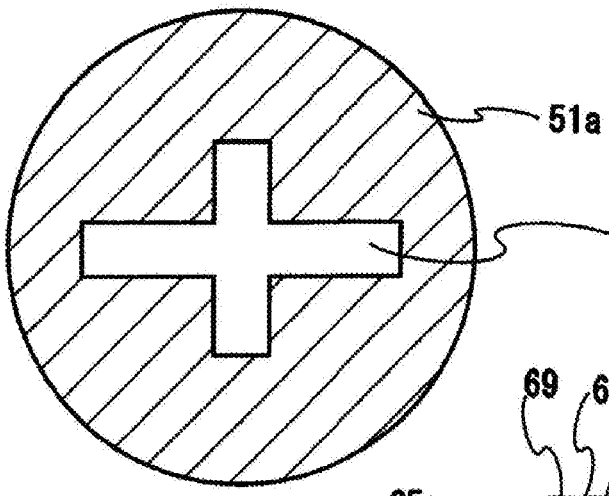
FIG. 5B
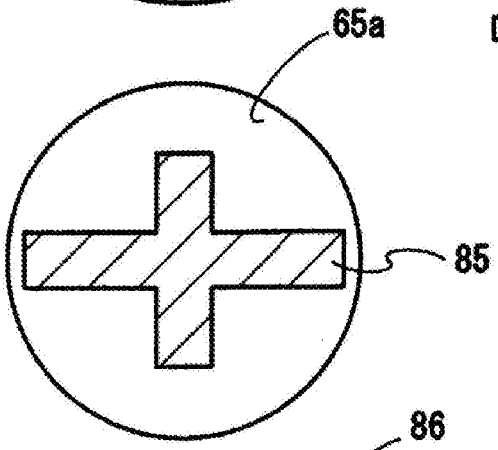
FIG. 5C
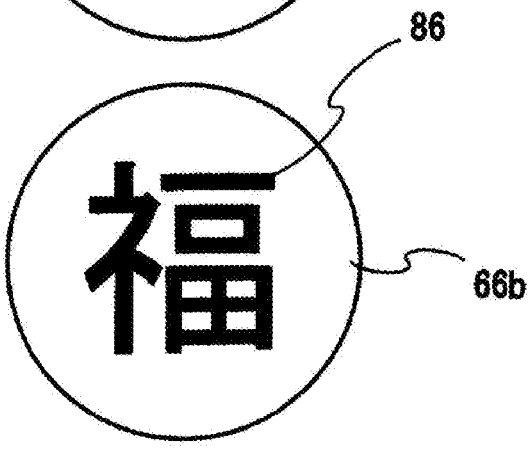
FIG. 5D
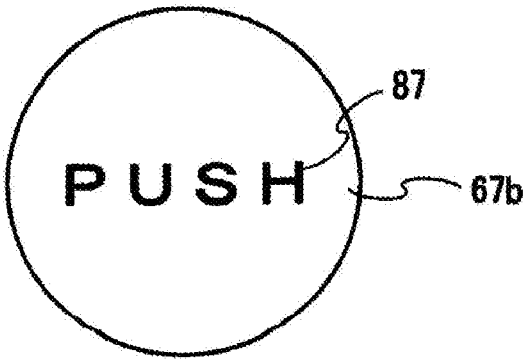
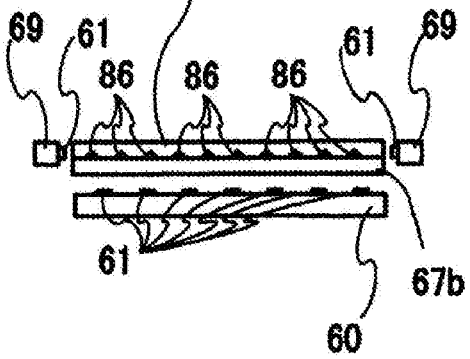
FIG. 5E

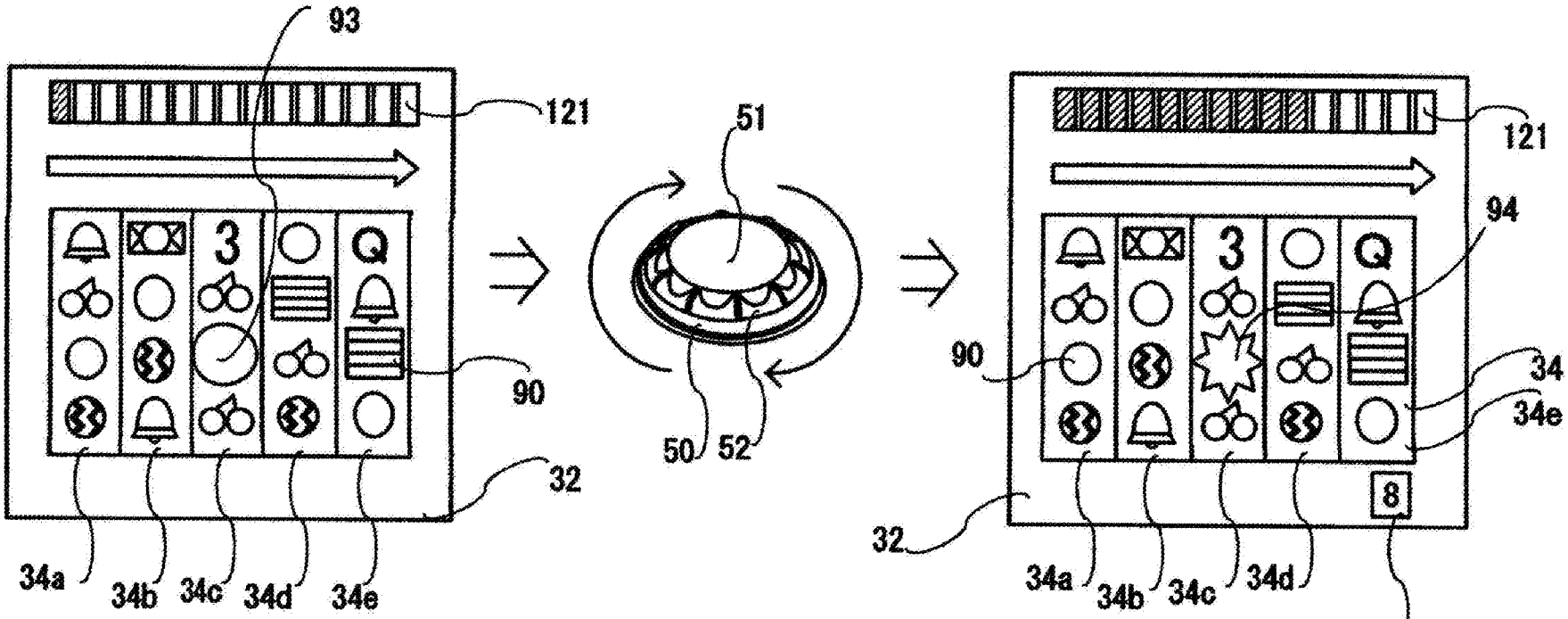
FIG. 7A
FIG. 7B
FIG. 7C
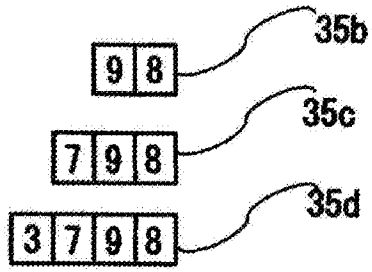
FIG. 7D
FIG. 7E
FIG. 7F

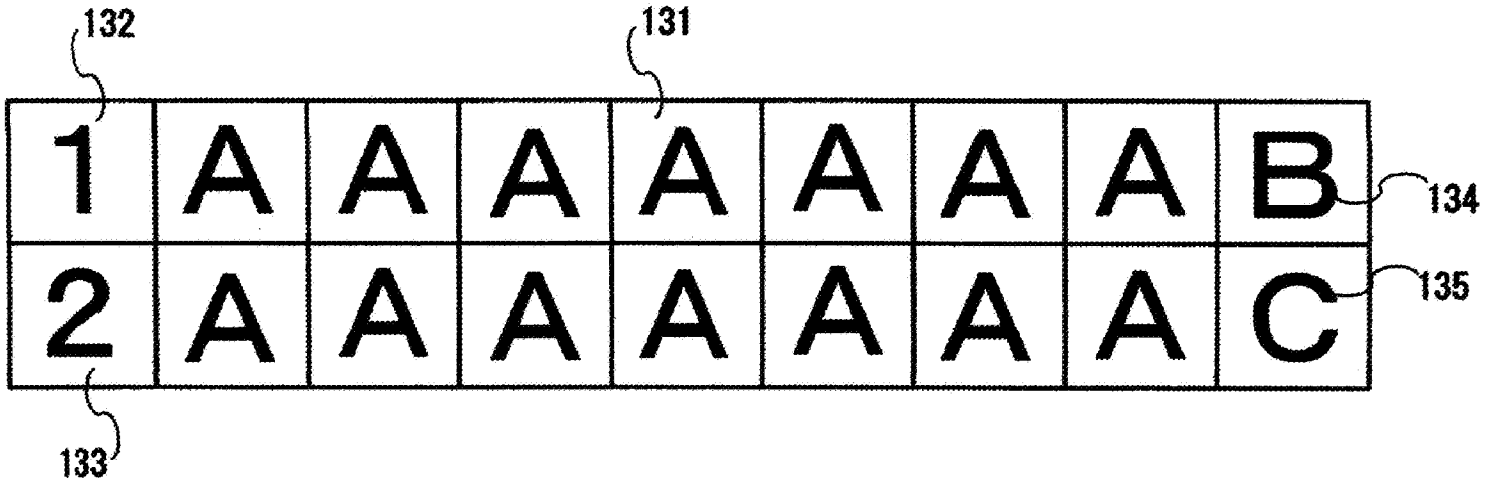
132
1
A
A
A

OPERATING DEVICE OF GAME MACHINE AND GAME MACHINE

BACKGROUND OF THE INVENTION

(1) Field of the Invention

The present invention relates to a game machine such as a slot machine or a video slot machine used in game parlors such as casinos.

(2) Description of Related Art

Conventionally, there is a game machine called a video slot, which is superior to conventional mechanical slot machines in that it can stimulate players through visual effects with video and animation.

With a bit of ingenuity, such visual expression on video may provide an exciting game to players. Especially, expressions applying software technology using animation include various expressions to live up a game as entertainment, and can attract players.

For example, the game machine described in JP 2011-92719 A has a display portion and a controller. The display portion displays a specific symbol placed in a specific cell. The symbol contains a specific type of symbol that is placed in the specific cell. The controller controls movements of the symbols and cells. The specific cell has a gauge. A numerical value indicated by the gauge represents a count of how many times the specific cell appears in the display portion. The controller compares the numerical value of the gauge with a threshold value, and sets a favorable condition to a player to be initiated when the numerical value of the gauge has reached the threshold value.

Patent document 1 JP2011-92719 A

SUMMARY OF THE INVENTION

However, in conventional game machines, it has been ended that a player has only waited for the game result while having watched expression of animation appearing on a display portion. Thus, the player has no element that can participate in the game while involving himself with the game result expressed for a long period of time, but only a sense of expectation of waiting for the result. The player may often expect expression that maintains a sense of expectation and game performance by a performance even when the player waits for a long period of time until the game result comes out.

An object of the present invention is to provide an operating device of a game machine and a game machine which allow a player to participate in a game until a game result comes out so as not to bore the player even for a period of time during which the game result comes out, and which achieve such a performance that maintains a sense of expectation for the game result.

The present invention provides an operating device of a game machine, the operating device being installed in the game machine including a display portion which displays the progress of a game in which a reel with a symbol disposed is stopped in accordance with a control of a body controller, and a result of the game, the operating device being configured to operate the progress of the game in conjunction with a display on the display portion, the operating device comprising a rotation operation portion capable of being rotated by a player, a rotation operation detecting portion which detects a state of rotation operation of the rotation operation portion, a decoration display portion which displays any one of a pattern, a symbol and a letter, or a combination thereof, and a connection portion which outputs a signal of the rotation operation detecting portion to the body controller and inputs a signal for controlling a display of the decoration display portion from the body controller.

According to the present invention with the above characteristics, it is possible to prevent a player from getting bored, and the player can participate in and enjoy a game by operating the operating device.

BRIEF DESCRIPTION OF THE DRAWINGS

FIGS. 5A to 5E are schematic views of the operating device for illustrating Examples 1 and 2 of the embodiment;

FIGS. 7A to 7F are explanatory views of the operating device of the game machine for illustrating Example 5 of the embodiment;

FIG. 18 is an explanatory view of a free game winning table in a free game for illustrating Example 16 of the embodiment.

DETAILED DESCRIPTION OF PREFERRED EMBODIMENT

Embodiment

An operating device of a game machine and the game machine according to the present invention will be described in detail with reference to the drawings. The following embodiments and drawings illustrate some of the embodiments of the present invention and are not intended to limit the present invention. Various modifications can be made within the scope of the present invention.

With reference to FIGS. 1 to 4, configurations of an operating device 50 of a game machine 20 and the game machine 20 will be described.

Figure 1:
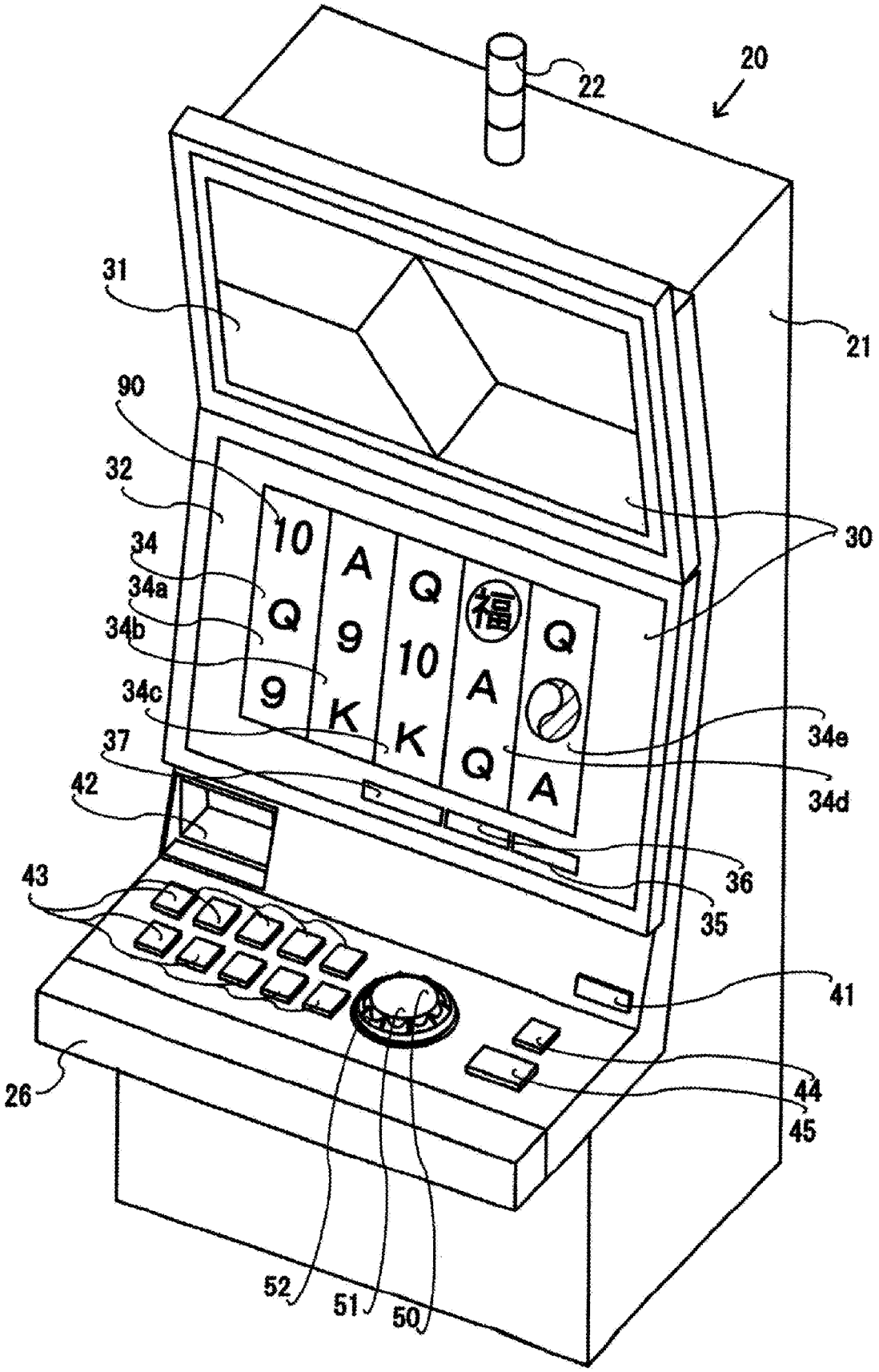
FIG. 1 is a perspective view of a game machine according to an embodiment.
Figure 2:
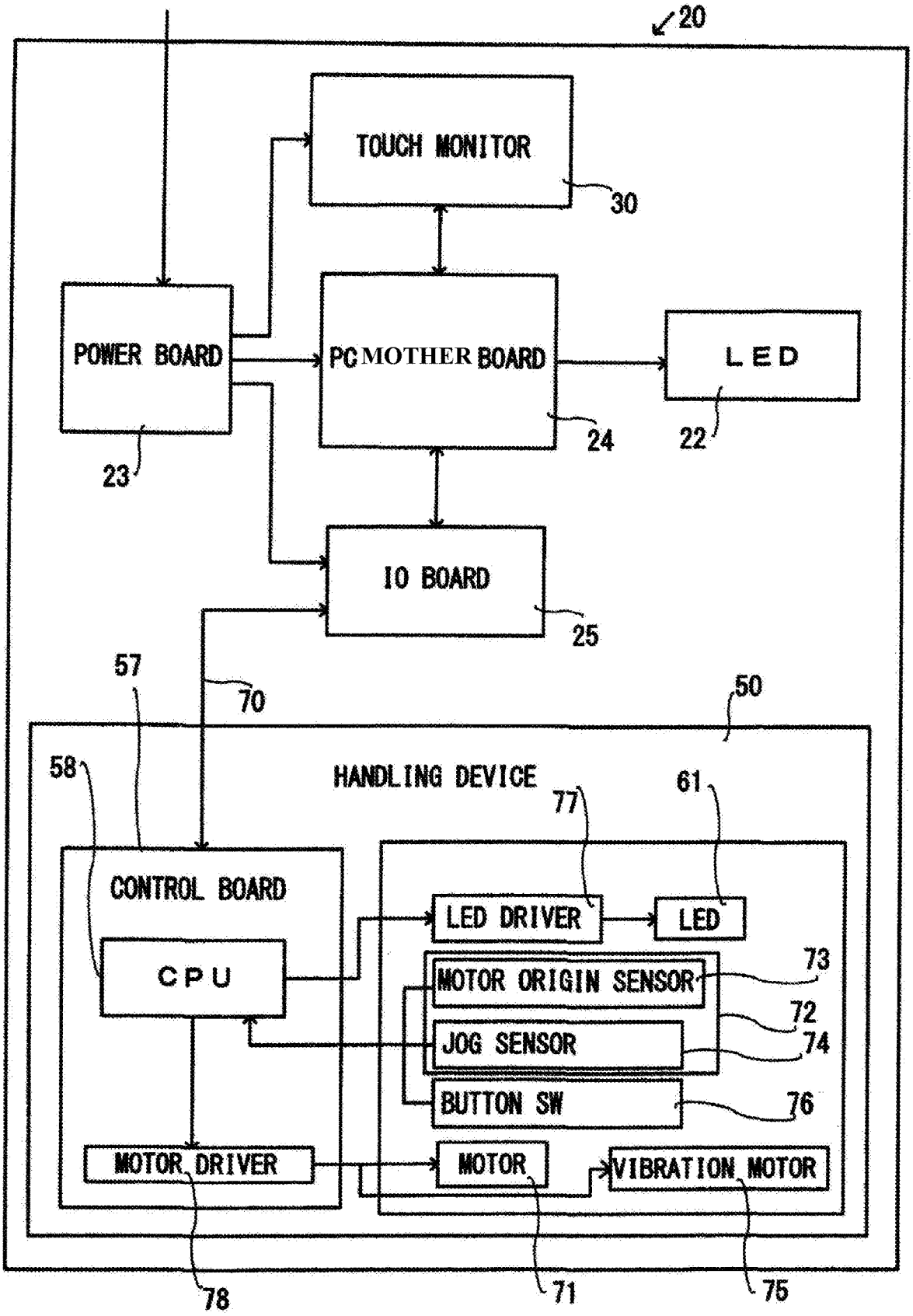
FIG. 2 is a block configuration diagram of the game machine according to the embodiment.
Figure 3:
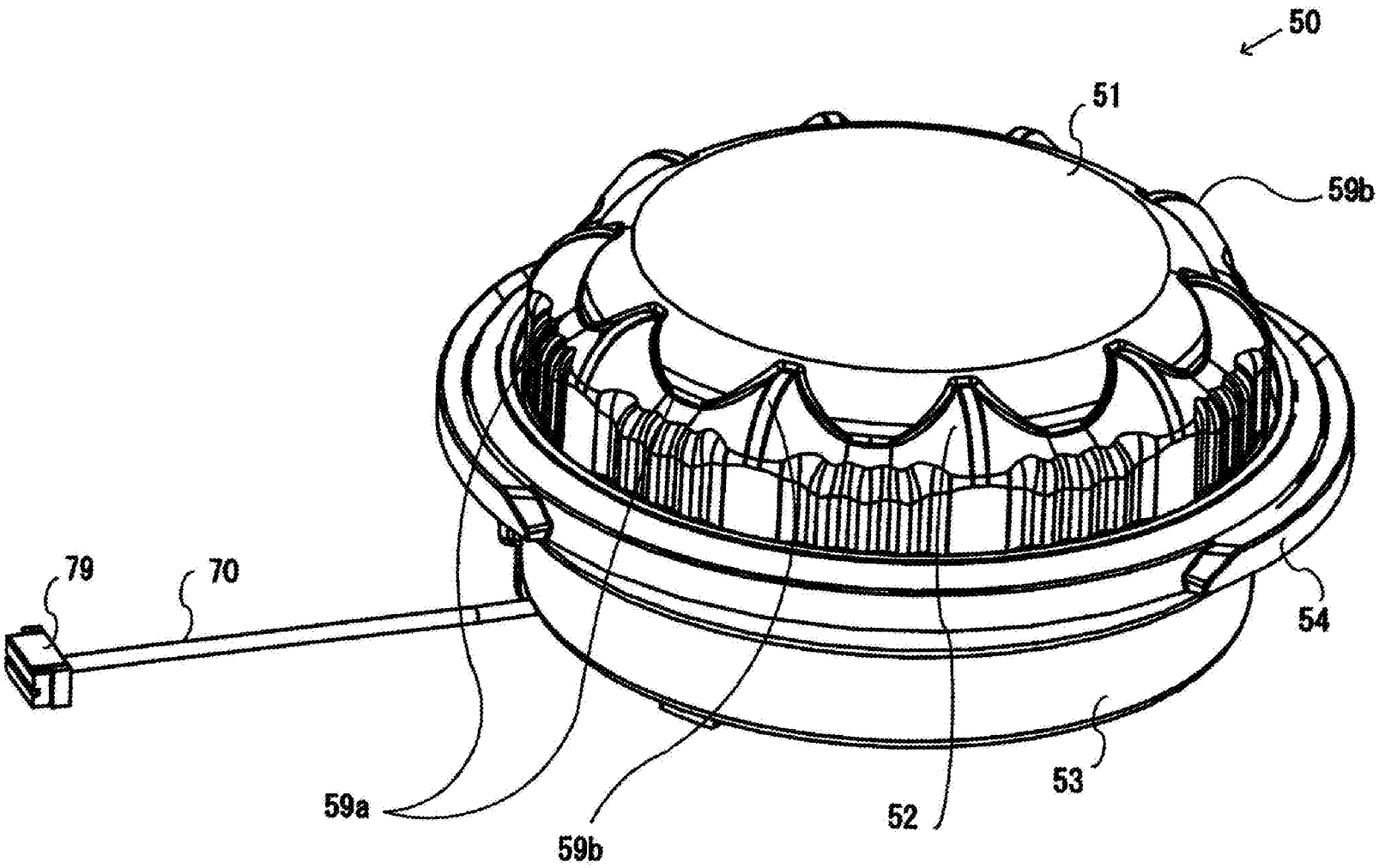
FIG. 3 is a perspective view of an operating device to be installed in the game machine according to the embodiment.
Figure 4:
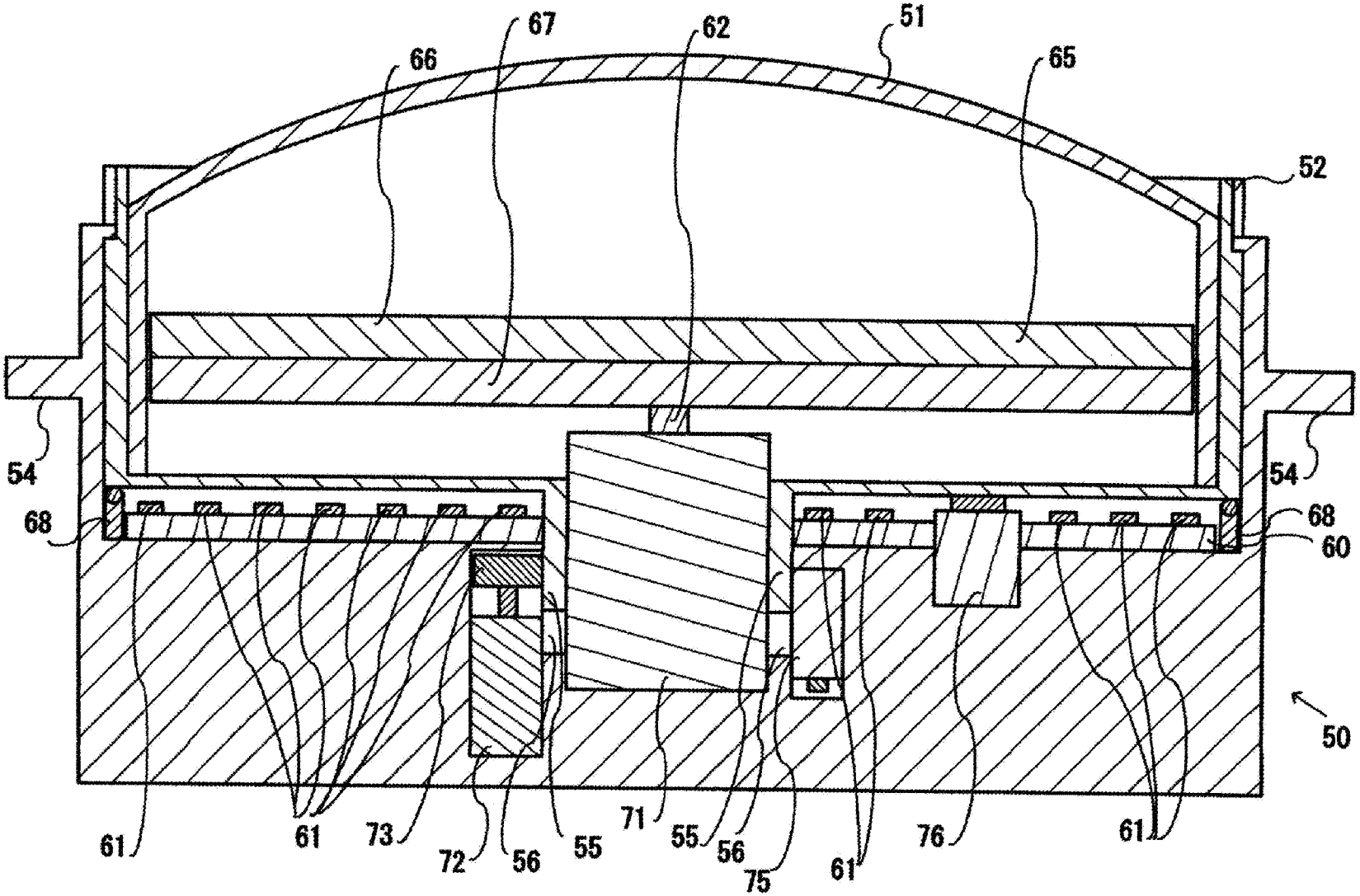
FIG. 4 is a schematic cross-sectional view showing an outline of the internal structure of the operating device to be installed in the game machine according to the embodiment.

FIG. 1 is a perspective view of the game machine 20 according to the embodiment. FIG. 2 is a block configuration diagram of the game machine 20 according to the embodiment. FIG. 3 is a perspective view of the operating device 50 installed in the game machine 20 according to the embodiment. FIG. 4 is a schematic cross-sectional view showing an outline of the internal structure of the operating device 50 installed in the game machine 20 according to the embodiment.

As shown in FIG. 1, the game machine 20 has an emergency LED 22 at the uppermost portion, a display portion 30 surrounded by a casing portion 21 at upper and intermediate portions, and a table 26 protruding at a lower portion.

While sitting on a chair (not shown), a player can enjoy a game while operating the operating device 50, a bet button 43, a spin button 45, and a payout button 44 provided on the table 26. The game machine 20 further has a bill acceptor 41 and a ticket printer 42 below the display portion 30. A ticket as a note, which is used in place of a bill or a coin and in which the amount of money is written, or a bill can be inserted through the bill acceptor 41, and a ticket on which the amount of payout is written is discharged through the ticket printer 42. The present embodiment is also applicable to a game in which coins are directly put into the game machine 20 and coins are directly paid out from the game machine 20.

The display portion 30 includes touch monitors 31 and 32 that are of a touch panel type. Although the display portion 30 includes two touch panel type monitors, the number of touch monitors is not particularly limited and may be three or more, or one, and the touch monitors 31 and 32 may not be of the touch panel type.

The display portion 30 displays, on a display screen of the touch monitor 31, the symbol 90 and the explanation of a payout amount in the symbol 90 at the normal time. At the normal time, the touch monitor 31 is used for display for a performance, for example when a bonus stage has been won.

The display portion 30 displays, on the display screen of the touch monitor 32, a reel 34, a payout display portion 35, a bet display portion 36, and a credit amount display portion 37.

In the reel 34, the three symbols 90 to be described later are vertically arranged on one reel 34, and the reels 34 (34*a*, 34*b*, 34*c*, 34*d*, and 34*e*) are horizontally arranged so that the five symbols 90 are arranged.

In the game machine 20, at the normal time, the reels 34 stop in order of the normal-time reels 34*a*, 34*b*, 34*c*, 34*d*, and 34*e*. In the game machine 20, a benefit occurs when the reels 34 stop and the same predetermined number of symbols 90 stop on the line. When a predetermined number of special symbols 90 (such as trigger symbols or wild symbols) stop, the game machine 20 shifts from a normal game to a bonus stage or a free game in which a high payout is obtained. The number of lines increases or decreases according to the number of bets selected by the bet button 43. The bet varies according to the bet button 43.

When the game machine 20 becomes in a state advantageous for the player during a performance as in Examples to be described later, the game machine 20 changes the order in which the reels 34 start to vary, or the variation is started such that an interval at which one or a plurality of the reels 34 start to vary is different from the interval at the normal time, so that a mode different from the normal time is provided. This mode can make the player feel a sense of expectation that it becomes in the state advantageous for the player.

When the game machine 20 shifts from the state advantageous for the player, such as a free game or a bonus stage, to a normal game, if the previous stop symbols 90 as spots remain as they are, a misunderstanding may be given to the player.

Thus, the game machine 20 stores as an initial value the arrangement of the reels 34 displaying the symbols 90 displayed beforehand at the time of turning on the power, and when the game machine 20 has shifted from the state advantageous for the player to the normal game, the arrangement of the reels 34 displaying the previous stop symbols 90 is deleted, and the arrangement of the reels 34 displaying the symbols 90 as the initial value is displayed. With the above display, no misunderstanding is given to the player.

Next, the main configuration of the game machine 20 will be described with reference to the block diagram of FIG. 2. In the game machine 20, each device is operated by a command from a mother board 24 on which a computer incorporating a hard disk, ROM and RAM is mounted. The game machine 20 controls power supplied from an external power supply with a power supply board 23 and supplies the power from the power supply board 23 to each device.

The mother board 24 controls the display portion 30 (touch monitors 31 and 32) and the emergency LED 22 displayed in case of emergency, and further controls each device via an I/O board 25. The I/O board 25 is also connected to a speaker (not shown), the bet button 43, the spin button 45, the payout button 44, the bill acceptor 41, the ticket printer 42 (FIG. 1), and so on.

The operating device 50 is connected to the mother board 24 via a CPU 58, the control board 57 incorporating ROM and RAM, and the I/O board 25. The mother board 24 uses the same CPU, has an OS (operation software), and controls the display portion 30 and the operating device 50, including the I/O board.

Under control of the software on the OS driven by the CPU of the mother board 24, the game machine 20 controls benefit as a state advantageous for the player, a stage bonus, and a winning amount of a free game, further controls the display portion 30 reflecting the result obtained from the winning, and furthermore controls the operating device 50.

Using the control program driven by the same OS driven by the same installed CPU of the mother board 24, the game machine 20 performs lotteries such as benefit, a stage bonus, and benefit of a winning game of a free game, which are advantageous for players, controls the symbols 90 and the reel 34 of the display portion 30, and further controls the operating device 50. Consequently, the control for the display portion 30 can be interlocked with the control for the operating device 50 with less time lag, and, in addition, it is difficult to perform fraudulent acts and the like.

Since the mother board 24 allows bidirectional communication with the operating device 50 via the I/O board 25, the mother board 24 can be easily connected and easily interlock with the operating device 50, and skipping of data from the operating device 50 due to electrical noise is also reduced. The control program is provided with a notifying control program that operates a notifying control portion to be described later and an operating device control program that controls the operating device 50.

The mother board 24 controls a motor 71 via a motor driver 78 of the control board 57 and further controls lighting of an LED 61 provided in a light source portion 60 shown in FIG. 4 and light emission color of the LED 61 via an LED driver 77. The LED 61 uses a monochromatic or full color LED.

In the operating device 50, a rotation operation detecting portion 72 detects the rotation direction and the number of rotations with an origin detecting portion 73 and a jog sensor 74, and further detects whether or not a push button portion 51 is pushed by a button switch 76. The detected data is output to the mother board 24 via the I/O board 25.

Next, the appearance of the operating device 50 will be described with reference to FIG. 3. The operating device 50 is provided with the flat and transparent push button portion 51 whose upper portion is curved on an arc that is easy for a player to place the palm thereon. The operating device 50 is further provided with a rotation operation portion 52 which has a cutout circular arc portion 59*a* having a circular arc cutout and provided on the side of the push button portion 51 and a circular arc protruding portion 59*b* protruding in an arc shape around the outer circumference. The rotation operation portion 52 has a shape such that a finger is hooked on the cutout circular arc portion 59*a* and the circular arc protruding portion 59*b* during rotation. The push button portion 51 and the rotation operation portion 52 are integrally configured, are depressed in conjunction with push operation, and rotate together with rotation operation.

In the operating device 50, a flange portion 54 is provided, and a body portion 53 incorporating the control board 57 (FIG. 2) and the light source portion 60 (FIG. 4) is provided below the flange portion 54. In the operating device 50, a portion below the flange portion 54 is housed inside the table 26 and fixed to the table 26. A USB terminal 79 is provided at the tip of a cable 70 so as to be able to be electrically connected to the I/O board 25 (FIG. 2) or the mother board 24 (FIG. 2).

Next, the internal structure of the operating device 50 will be described with reference to FIGS. 2 to 4. The operating device 50 is provided with the curved push button portion 51 whose upper portion is transparent, and the side portion of the push button portion 51 is integrally fixed with the rotation operation portion 52. In addition, a rotation driving portion 65 is provided in a space below the push button portion 51.

The rotation driving portion 65 integrally fixes a decoration display portion 66 and a rotation fixing portion 67 and fixes the motor 71, which pivotally supports the rotation fixing portion 67 on a shaft 62, to the center of the body portion 53. In the rotation driving portion 65, the decoration display portion 66 can be rotated by the rotation of the motor 71. In the decoration display portion 66, any one of a pattern, a symbol and a letter, or a combination thereof is engraved, printed, or three-dimensionally formed. The rotation driving portion 65 cannot only rotate at a constant rotation speed according to a performance but also can be controlled by changing the rotation speed.

In the rotation operation portion 52 integrally formed with the push button portion 51, a rotation shaft 55 is provided so as to be rotatable around the motor. The body portion 53 is provided with urging means 56 including an urging spring, rubber or the like and provided below the rotation shaft 55, and the urging means 56 urges the rotation operation portion 52 upward. The body portion 53 is further provided with a ball urging receiver 68 so that the rotation operation portion 52 can be stably rotated and depressed.

The ball urging receiver 68 has a rotary sphere therein and slides with the rotation operation portion 52, and the rotary sphere rotates in accordance with the rotation of the rotation operation portion 52. For the ball urging receiver 68, urging means (not shown) similar to the above-described urging means is provided so that the rotary sphere moves vertically in conjunction with vertical movement of the rotation operation portion 52.

When the push button portion 51 is pushed, the rotation operation portion 52 moves downward and pushes the button switch 76 to detect whether the push button portion 51 is pushed or not. As the button switch 76, a mechanical switch, an optical switch, or the like is used.

The body portion 53 is provided with the light source portion 60 below the rotation operation portion 52. The light source portion 60 includes a plurality of LEDs 61 and transmits the transparent rotation operation portion 52 to illuminate the decoration display portion 66 and the like.

A rotation operation detecting portion 72 abuts against the rotation shaft 55 of the rotation operation portion 52, and as an origin detecting portion 73 rotates in conjunction with the rotation shaft 55, the rotation operation detecting portion 72 detects the number of rotations. The origin detecting portion 73 serves as the jog sensor 74 which detects the rotation direction. Although the jog sensor 74 may serve as the origin detecting portion 73 as in the present embodiment, a separate sensor which detects the rotation direction may be provided.

In the rotation operation portion 52, a vibration motor 75 is provided in an abutted state in order to notify a player that it is advantageous for the player during performance by vibration of the rotation operation portion 52.

Although the light source portion 60 can emit light in multiple colors with a full-color LED, a payout amount or odds can be previously determined with the light emission color of the light source portion 60, and the payout amount or odds can be used. When the number of coins is from 1 to 9, the light emission color is blue. When the number of coins is from 10 to 99, the light emission color is green. When the number of coins is from 100 to 999, the light emission color is red. When the number of coins is from 1000 to 9999, the light emission color is rainbow color.

The light source portion 60 can be used for a performance that for example, when there is a payout, with the rotation of the rotation operation portion 52 as a trigger, the light emission color is changed in order of blue, green, red, and rainbow colors at a high speed that allows players to recognize the color, and all payout amounts are determined by the push button portion 51. In particular, when a large dividend is to be paid out, the light source portion 60 does not display the blue and green light emission colors but changes sequentially only the red and rainbow light emission colors which are high price suggestions, so that it is possible to give the player an expectation that a large dividend is paid out.

Example 1

Next, a performance using the operating device 50 will be described with reference to FIGS. 3 to 5. Example 1 shows operation of the notifying control portion notifying beforehand that it is advantageous for a player while a game is in progress and shows a case where information is performed. Examples of the state in which it is advantageous for a player include payment of a large dividend, a bonus stage, high odds, and a state in which a free game is won, and it can be applied to other examples besides this example.

In this example, as shown in FIGS. 3, 4, and 5B, a rotation driving portion 65*a* rotates, and a pattern of a cross 85 is colored, or the decoration display portion 66 formed three-dimensionally is provided. Other portions are transparent so that light from the light source portion 60 can transmit.

In the push button portion 51, as shown in FIGS. 3, 4, and 5A, a transparent cross 84 having the same shape and size as the cross 85 is formed, and the other portion is printed or sealed so that the light from the light source portion 60 provided below does not leak out.

As described above, in the transparent cross 84, the rotation driving portion 65*a* rotates in accordance with the progress of a game, so that the light from the light source portion 60 below the transparent cross 84 can be visually recognized, like a beautiful kaleidoscope. The rotating motion seen through the transparent cross 84 can provide a performance giving a sense of expectation to a player.

Example 2

Next, a performance using the operating device 50 will be described with reference to FIGS. 3, 4, and 5C to 5E. Example 2 shows a case where a display prompting a player to push the push button portion 51 is performed so as to allow the player to participate in a game while the game is in progress, or a case where the notifying control portion notifying beforehand that it is advantageous for a player is operated, and a case where information is performed.

In this example, instead of the motor 71 of the rotation driving portion 65*a*, the decoration display portions 66*b* and 67*b* are changed in two modes.

FIG. 5E is a schematic view showing portions of the decoration display portions 66*b* and 67*b* from the side. In the decoration display portion 66*b*, the letter "Fuku" (a Chinese character) is engraved on a transparent light guide plate by a light guide portion 86, and the letter is reflected from the side by the light of the LED 61 provided in a side light source portion 69 so that the letter appears.

On the other hand, in the lower decoration display portion 67*b* in close contact with the decoration display portion 66*b* is printed such that the letter "PUSH" is capable of transmitting the light from the LED 61 of the lower light source portion 60, and the other portion is printed in black and shields the light. As described above, in the decoration display portions 66*b* and 67*b*, a different letter appears by changing the light emitting portion of the LED 61.

The player is encouraged to push the operating device 50 thus configured, so that the player can participate in and enjoy the game. In addition, two different displays are possible even in the thin operating device 50.

Example 3

Figures 6A, 6B:
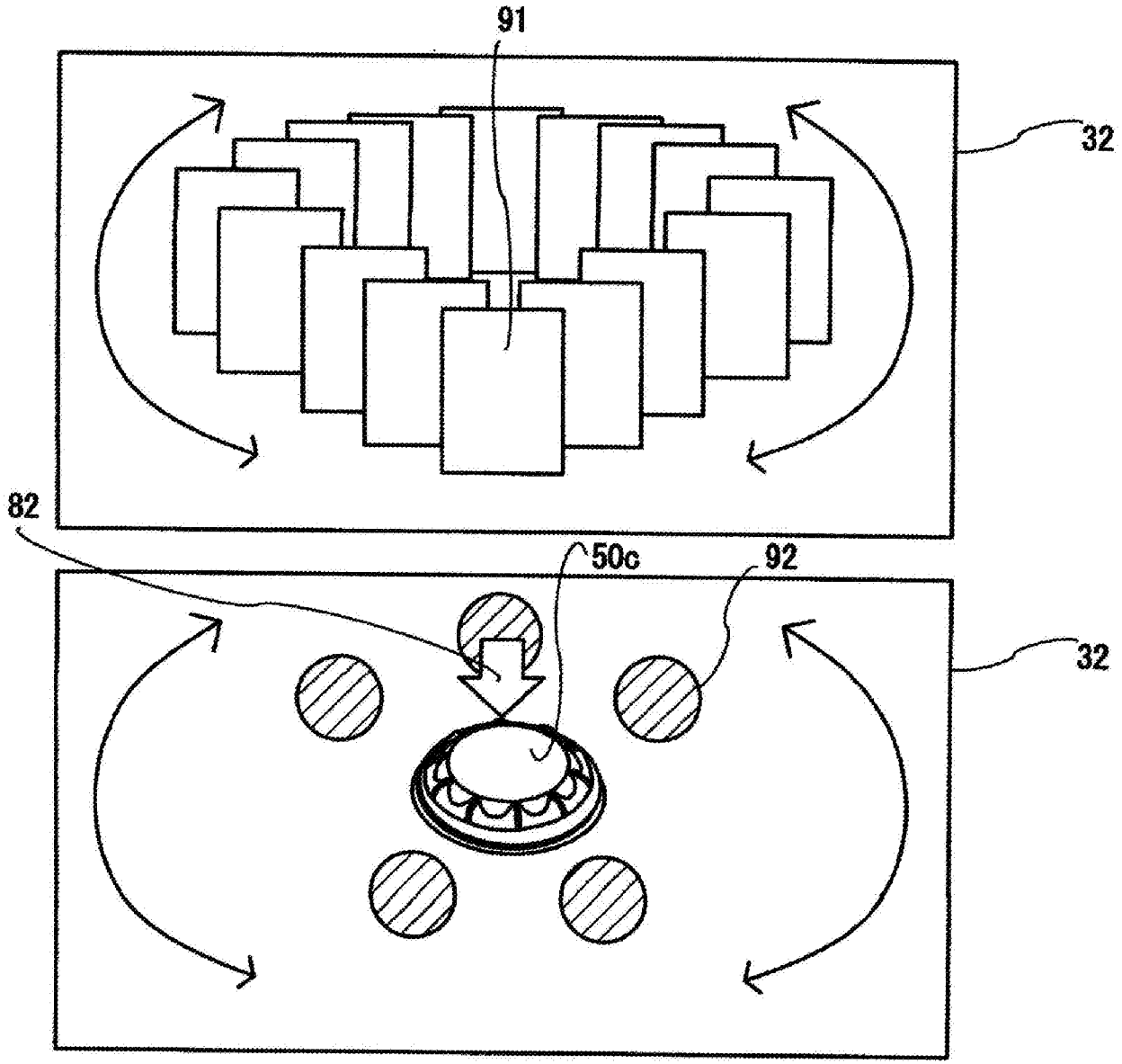
FIGS. 6A and 6B each show a display image of a display portion of the game machine for illustrating Examples 3 and 4 of the embodiment.

Example 3 is an example of the operating device 50 in a case where a player selects the progress of a game while the game is in progress, as shown in FIGS. 1 and 6A.

In FIG. 6A, a selection card 91 selected on the touch monitor 32 is three-dimensionally displayed on the display screen. The selection cards 91 are arranged in a circular shape and rotate left and right according to the rotation of the rotation operation portion 52, and the arrangement of the selection card 91 in front is changed.

The player rotates the rotation operation portion 52 to place the selected selection card 91 in front and depresses the push button portion 51 to determine the selection card 91. The game progresses according to the contents described on the determined selection card 91.

For example, the selection card 91 describes displays of a payout amount, odds, or winning of a free game, and winning of a bonus stage.

Example 4

Example 4 is an example of the operating device 50 in a case where a player selects the progress of a game while the game is in progress, as shown in FIGS. 1 and 6B.

In FIG. 6B, a sphere 92 selected on the touch monitor 32 is three-dimensionally displayed on the display screen. The spheres 92 are arranged in a circular shape and rotate left and right according to the rotation of the rotation operation portion 52, and the arrangement of the sphere 92 in front is changed. The touch monitor 32 displays a pseudo operating device 50*c* on the display screen to prompt the operation of the operating device 50.

The player rotates the rotation operation portion 52 to place the selected sphere 92 in front and depresses the push button portion 51 to determine the sphere 92. The game progresses according to the contents described on the determined sphere 92.

For example, the sphere 92 describes displays of a payout amount, odds, or winning of a free game, winning of a bonus stage, and the like.

Example 5

In Example 5, as shown in FIG. 7, the operating device 50 and the touch monitor 32 are interlocked so that a player can participate in a game while the game is in progress.

In FIG. 7A, the symbols 90 are displayed on the respective reels 34 (34*a*, 34*b*, 34*c*, 34*d*, and 34*e*).

FIG. 7A shows a case where a special symbol 93 appears on the reel 34*c*. The display screen of the touch monitor 32 displays a process in which when the special symbol 93 appears, if the operating device 50 is rotated as shown in FIGS. 7B and 7C, the special symbol 93 is gradually changed to a change symbol 94 (such as a wild symbol, a symbol corresponding to a high payout, or a trigger symbol to be described later) with the rotation. Thus, the player expects what the special symbol 93 will change, and can participate in the game by rotating the operating device 50.

In the process of gradually changing the symbol, in the case where the operating device 50 is rotated left and right, when the operating device 50 is rotated to the right, the middle state of the change to the change symbol 94 displays, and when the operating device 50 is rotated to the left, the middle state returns to the special symbol 93. The process of gradually changing the symbol depends on the rotation speed of the operating device 50, and if the operating device 50 is rotated fast, the speed of the process of changing to the change symbol 94 increases.

When the rotation operation portion 52 is rotated, the touch monitor 32 shown in FIGS. 7A and 7C determines the rotation speed per unit time from the rotation number detected by the origin detecting portion 73 (FIGS. 2 and 4) and displays the rotation speed on a speed display portion 121. The speed display portion 121 indicates that the larger a memory gauge, the faster the rotation speed of the rotation operation portion 52. Thereby, the player can participate in the game by rotating the operating device 50.

As shown in FIGS. 7C to 7F, in payout display portions 35*a*, 35*b*, 35*c*, and 35*d* representing the earned amount on the touch monitor 32 with numbers, in accordance with the rotation of the rotation operation portion 52 of the operating device 50, the number of digits of the number of the earned amount is gradually displayed in order of the payout display portions 35*a*, 35*b*, 35*c*, and 35*d*, and the player can enjoy the display with expectation until the end.

By pushing the push button portion 51, all the amounts earned at one time may be displayed on the payout display portion 35*d* without rotating. The number of digits to be displayed may be read aloud by voice. For example, in accordance with the rotation of the rotation operation portion 52 of the operating device 50, the number of the earned amount may be displayed in order such as "1, 10, 100, 1000, 10000".

When the rotation operation portion 52 of the operating device 50 is rotated, the color of a frame of the payout display portion 35 may be changed so as to indicate the payout amount. For example, the payouts are different in order of 10 coins for the blue frame, 100 coins for the green frame, and 1000 coins for the red frame, and when the rotation operation portion 52 is rotated, the color of the corresponding frame gradually changes. The frame color changes in order of blue, green, and red to change a payout expectation value, and all the payout amounts are displayed on the payout display portion 35 by pushing the push button portion 51.

Example 6

In Example 6, as shown in FIG. 8, the operating device 50 and the touch monitor 32 are interlocked so that a player can participate in a game while the game is in progress, and the result of the game can be displayed on the touch monitor 32.

Figure 8A:
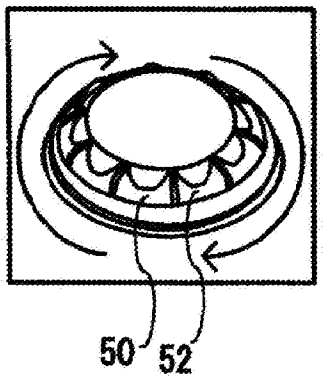
FIGS. 8A to 8D each show a display image of the display portion of the game machine for illustrating Example 6 of the embodiment.
Figure 8B:
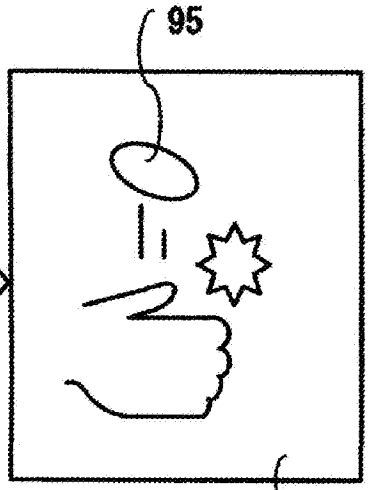

As shown in FIG. 8A, first, when the rotation operation portion 52 of the operating device 50 is rotated, as shown in FIG. 8B, a toss coin 95 and a hand are displayed on the display screen of the touch monitor 32, and a state in which the hand tosses the coin is displayed thereon.

Figure 8C:
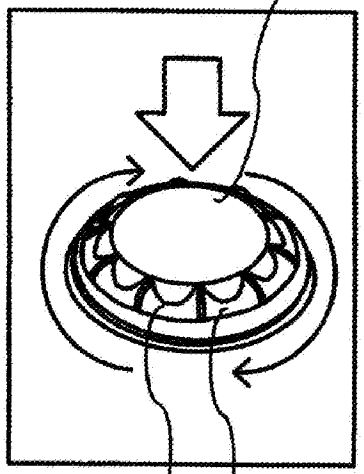

In addition, as shown in FIG. 8C, a performance that the toss coin 95 flies high is performed according to the rotation speed or the number of rotations of the rotation operation portion 52. During this performance, in addition to changing the height of the toss coin 95 in accordance with the rotation speed of the rotation operation portion 52, the performance that the rotation speed of the toss coin 95 increases may be performed.

The height or rotation of the toss coin 95 may be used as a performance of the notifying control portion notifying beforehand that it is advantageous for a player before the game result comes out. When the height of the toss coin 95 is high, or when the rotation is fast, this performance can be used as a performance with a high expectation, such as payment of a large dividend, high odds, or winning of a bonus stage or a free game.

Figure 8D:
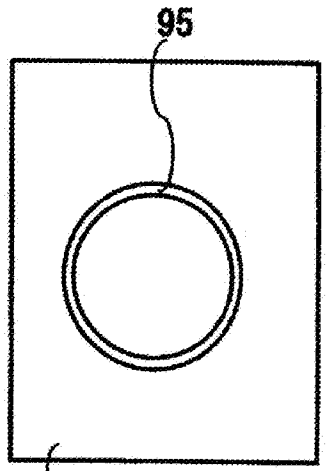

As shown in FIGS. 8C and 8D, by depressing the push button portion 51, the state of the front and back of the toss coin 95 is finally displayed, and the game result is displayed.

Thus, the player can participate in and enjoy the game.

Example 7

In Example 7, as shown in FIG. 10, the operating device 50 and the touch monitor 31 are interlocked so that a player can participate in a game while the game is in progress, and the result of the game can be displayed on the touch monitor 31.

Figure 10A:
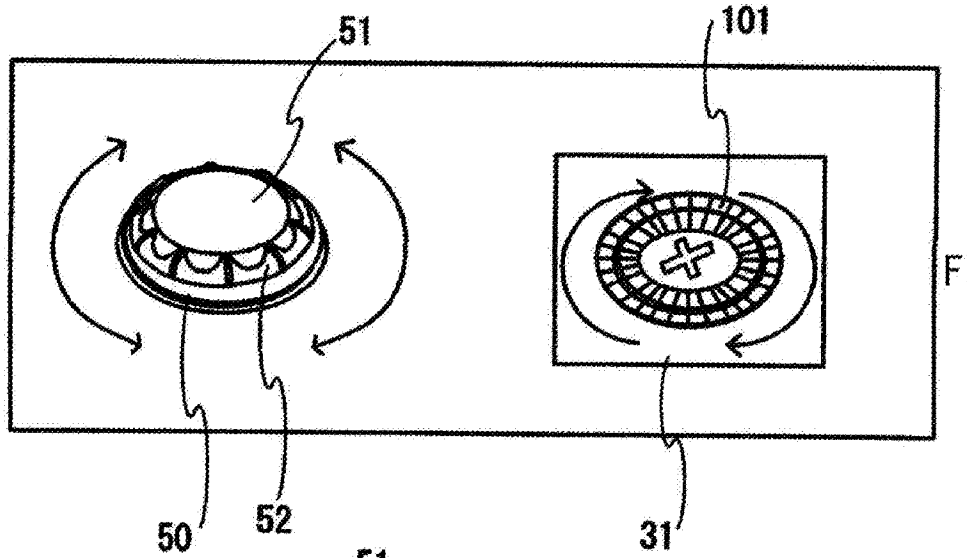
FIGS. 10A to 10D each show a display image of the display portion of the game machine for illustrating Example 8 of the embodiment.

As shown in FIG. 10A, when the rotation operation portion 52 of the operating device 50 is first rotated, a state in which a roulette 101 rotates is displayed on the display screen of the touch monitor 31.

Figure 10B:
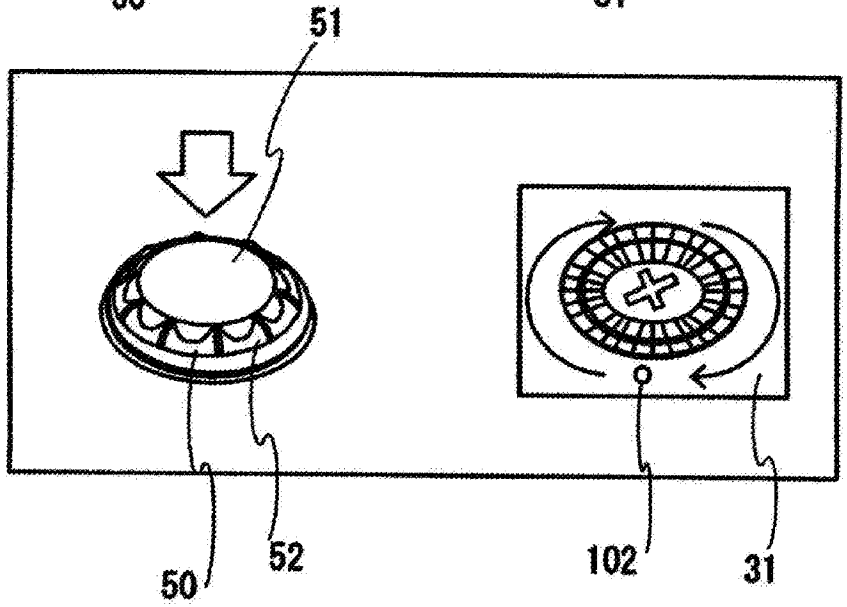

In this case, the rotation operation portion 52 of the operating device 50 is rotated beforehand, a spot of the roulette 101 is selected, and the spot is determined by depressing the push button portion 51 as shown in FIG. 10B.

A ball 102 of the roulette is thrown by depressing the push button portion 51. When a predetermined time elapses, the roulette 101 stops, and the game result is displayed.

This performance can be used as a performance with a high expectation, such as payment of a large dividend, high odds, or winning of a bonus stage or a free game. The game result may be displayed in conjunction with an actual table game.

Figure 10C:
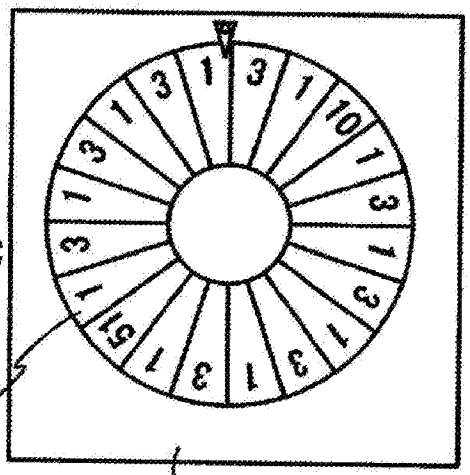

In addition, as a performance informing that a player is in an advantageous state by another game, as shown in FIGS. 1 and 10C, a wheel 105 with a number described is displayed on the touch monitor 31, and when the rotation operation portion 52 of the operating device 50 is rotated, the wheel 105 rotates. The push button portion 51 is depressed to stop the wheel 105, and the game result is displayed.

In this case, the rotation operation portion 52 of the operating device 50 is rotated beforehand, a spot of the wheel 105 is selected, and the spot is determined by depressing the push button portion 51.

Figure 10D:
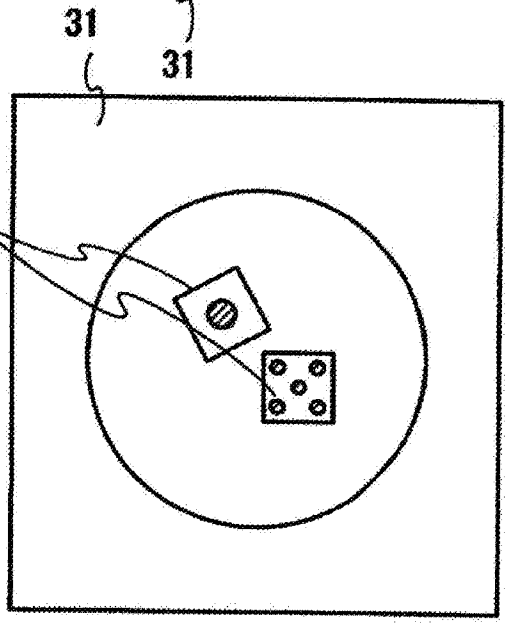

As shown in FIGS. 1 and 10D, there is a performance that when the rotation operation portion 52 of the operating device 50 is rotated, the dice 107 rolls, and the push button portion 51 is depressed to stop the dice 107 and thus to display the game result. In this case, the rotation operation portion 52 of the operating device 50 is rotated beforehand, a spot of the dice 107 is selected, and the spot is determined by depressing the push button portion 51.

As described above, the player can be prevented from being bored by displaying the performance of the other table games on the touch monitor 31, and the player can participate in and enjoy the game by operating the operating device 50.

Example 8

In Example 8, as shown in FIG. 9, the operating device 50 and the touch monitor 31 are interlocked so that a player can participate in a game while the game is in progress, and the result of the game can be displayed on the touch monitor 31.

Figure 9B:
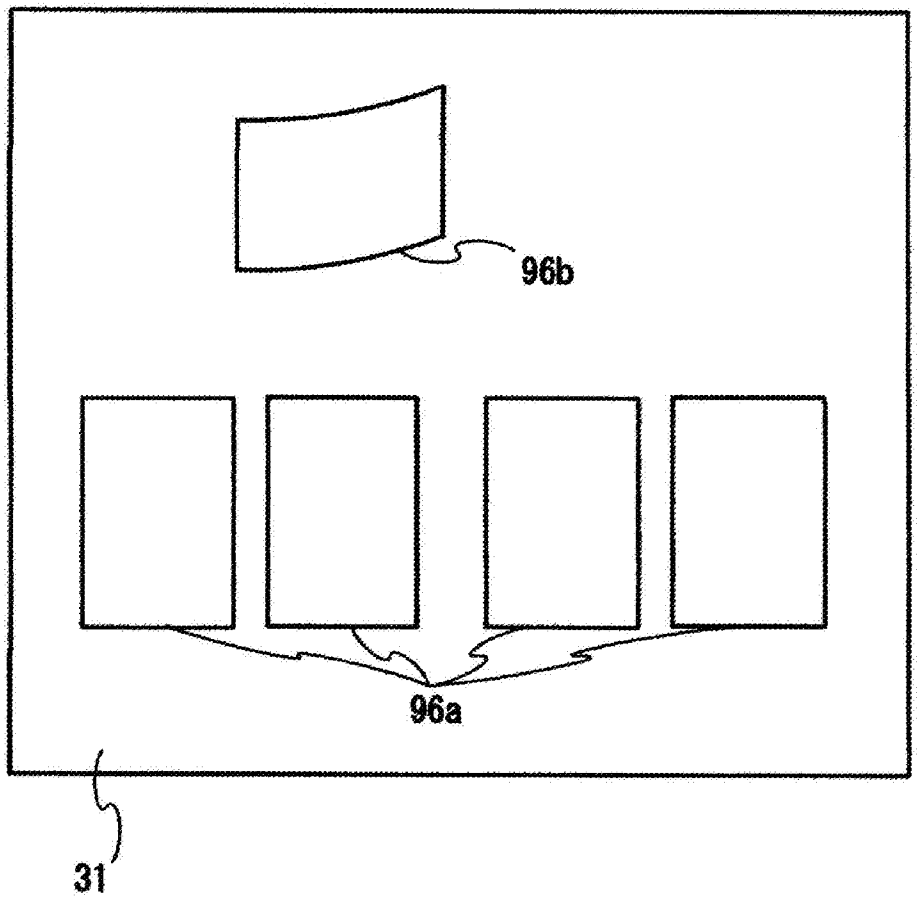
FIGS. 9A and 9B each show a display image of the display portion of the game machine for illustrating Example 7 of the embodiment.

As shown in FIG. 9B, a card game using playing cards frequently seen in table games is displayed on the display screen of the touch monitor 31.

Figure 9A:
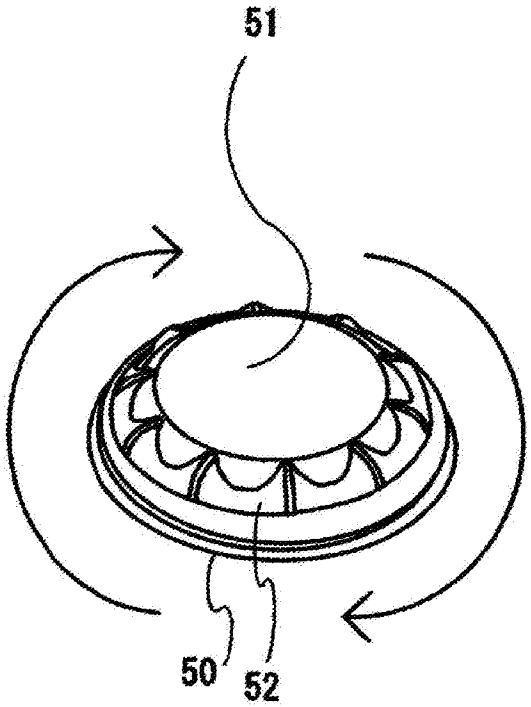

As shown in FIG. 9B, cards 96*a* whose surface with a number described appears are arranged, and such a display that the game result is decided by the last one card 96*b* appears on the display screen. When the rotation operation portion 52 of the operating device 50 is rotated as shown in FIG. 9A, such a display is performed that a portion of the card 96*b* is turned as shown in FIG. 9B when the rotation operation portion 52 is rotated to the right, and a portion of the card 96*b* is returned when the rotation operation portion 52 is rotated to the left. In this performance, by depressing the push button portion 51, all the cards 96*b* are turned, and the game result is displayed.

As described above, the player can participate in the game as though the player himself turns the card 96*b*. In addition, the player can participate in the game with expectation of the game result.

Example 9

Figure 11:
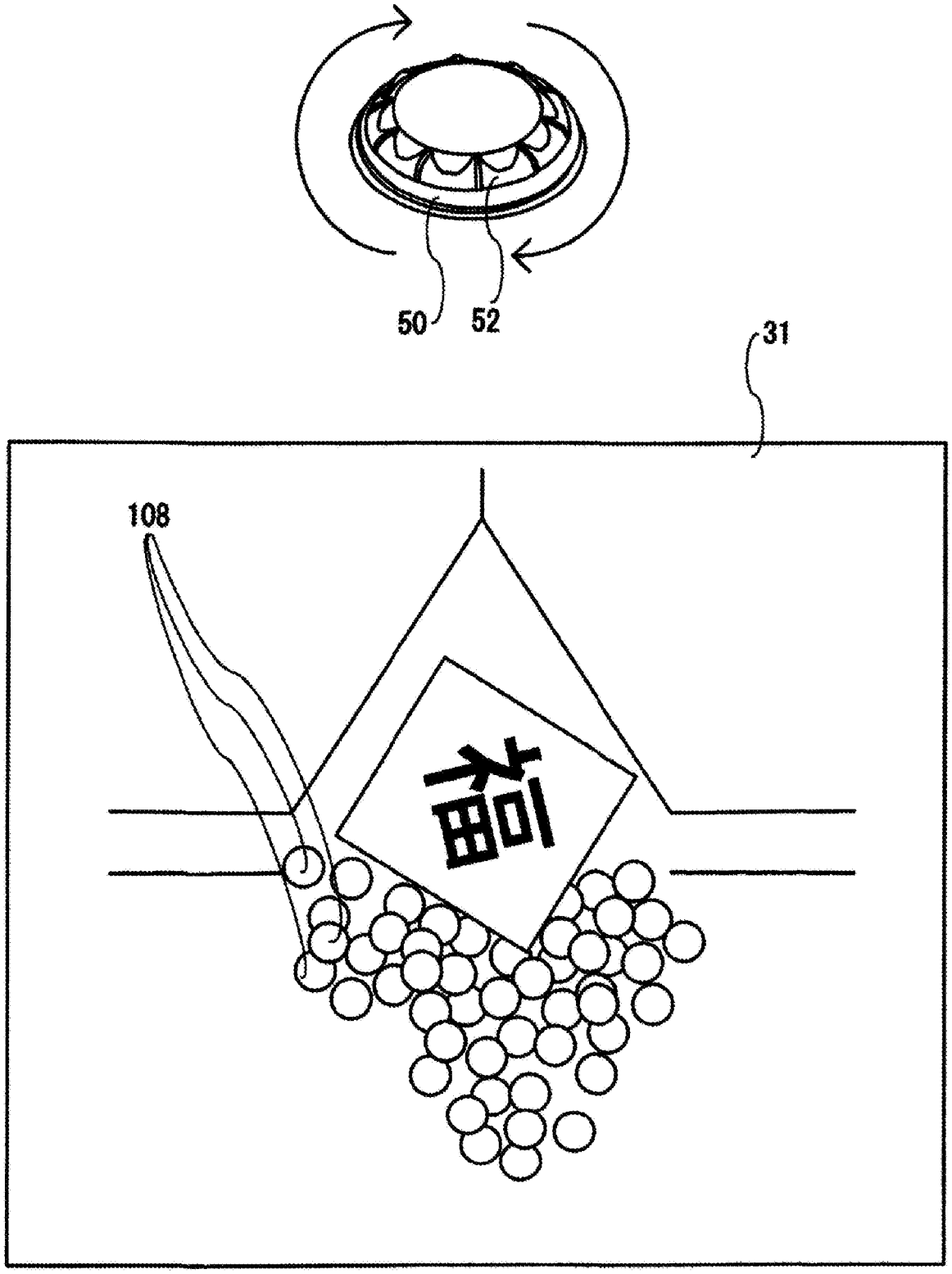
FIG. 11 is an explanatory view of a display image of the display portion and the operating device of the game machine for illustrating Example 9 of the embodiment.

In Example 9, as shown in FIG. 11, the operating device 50 and the touch monitor 31 are interlocked so that a player can participate in a game while the game is in progress, and the result of the game can be displayed on the touch monitor 31.

As shown in FIG. 11, the touch monitor 31 displays a performance in a case where a bonus stage is won and a large dividend is paid out. When the payout amount is fixed, the touch monitor 31 displays a state in which a large amount of coins 108 are being paid out in order to impress the player to acquire a large dividend.

When the rotation operation portion 52 of the operating device 50 is rotated, the number of the coins 108 to be paid out is changed and displayed on the touch monitor 31 in accordance with the speed or the number of times the rotation operation portion 52 is rotated.

As shown in FIGS. 4 and 11, it may be controlled so that the rotation speed of the rotation driving portion 65 is changed in conjunction with a state displayed on the touch monitor 31 where the large amount of coins 108 are paid out.

For example, in a case where the earned amounts are 100 coins, 1000 coins, and 10000 coins, if the number of coins is 100, the rotation driving portion 65 rotates once per second. If the number of coins is 1000, the rotation driving portion 65 rotates twice per second. If the number of coins is 10000, the rotation driving portion 65 rotates three times per second. It is indicated that the faster the rotation speed, the higher the earned amount.

Example 10

Figure 12:
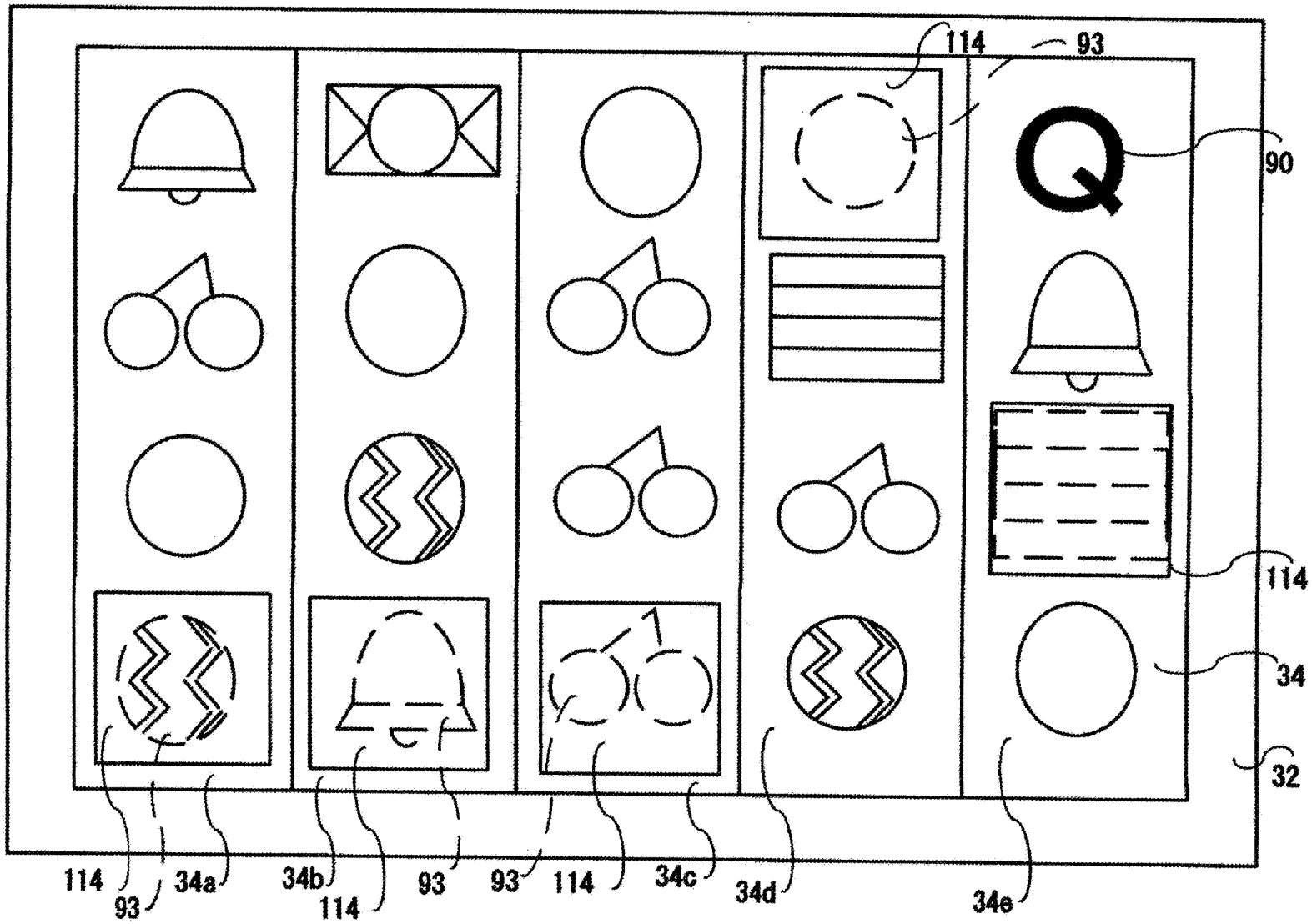
FIG. 12 shows a display image of the display portion of the game machine for illustrating Example 10 of the embodiment.

In Example 10, as shown in FIGS. 3 and 12, the operating device 50 and the touch monitor 32 are interlocked so that a player can participate in a game while the game is in progress, and the result of the game can be displayed on the touch monitor 32.

As shown in FIGS. 3 and 12, in the touch monitor 32, it is possible to perform a performance that, among the symbols 90 arranged on the reels 34 (34*a*, 34*b*, 34*c*, 34*d*, and 34*e*), some of the special symbols 93 are concealed by a partial cover portion 114, a pattern such as a tornado appears on the partial cover portion 114 concealing the symbol, and the symbol 90 finally appears by rotating the rotation operation portion 52 of the operating device 50. The pattern such as a tornado violently rotates in conjunction with the rotation speed of the rotation operation portion 52, and the special symbol 93 on the reel 34 on the touch monitor 32 changes to a wild symbol, a trigger symbol, or the like.

At this time, in the game machine 20, such a display may be performed that as the rotation speed of the rotation operation portion 52 increases or the number of rotations increases, a concealed portion of a wild symbol or a trigger symbol that appears after change decreases. Further, in the game machine 20, as the rotation speed of the rotation operation portion 52 increases or the number of rotations increases, the outline or shade of the symbol 90 may be gradually made darker, and the symbol 90 gradually appearing may be made easily recognizable.

As described above, in the game machine 20, the player can participate in and enjoy the game by operating the operating device 50.

Example 11

In Example 11, as shown in FIGS. 1 and 13, the operating device 50 and the touch monitor 31 are interlocked so that a player can participate in a game while the game is in progress, and the result of the game can be displayed on the touch monitor 31.

Figure 13A:
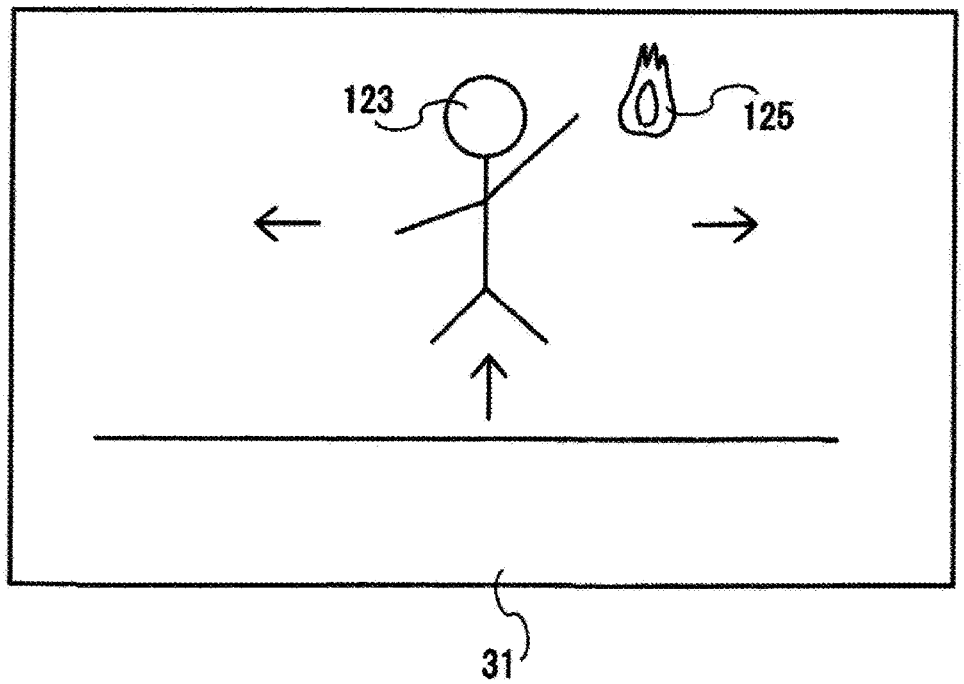
FIGS. 13A and 13B each show a display image of the display portion of the game machine for illustrating Example 11 of the embodiment.

As shown in FIGS. 1 and 13A, in the game machine 20, when a bonus stage or the like is won, the rotation operation portion 52 of the operating device 50 is rotated left and right to operate left and right a character 123 displayed on the touch monitor 31. The player depresses the push button portion 51 with good timing, whereby if the character 123 successfully catches a flame character 125, the game result is displayed. The result of the game may be a payout or odds.

Figure 13B:
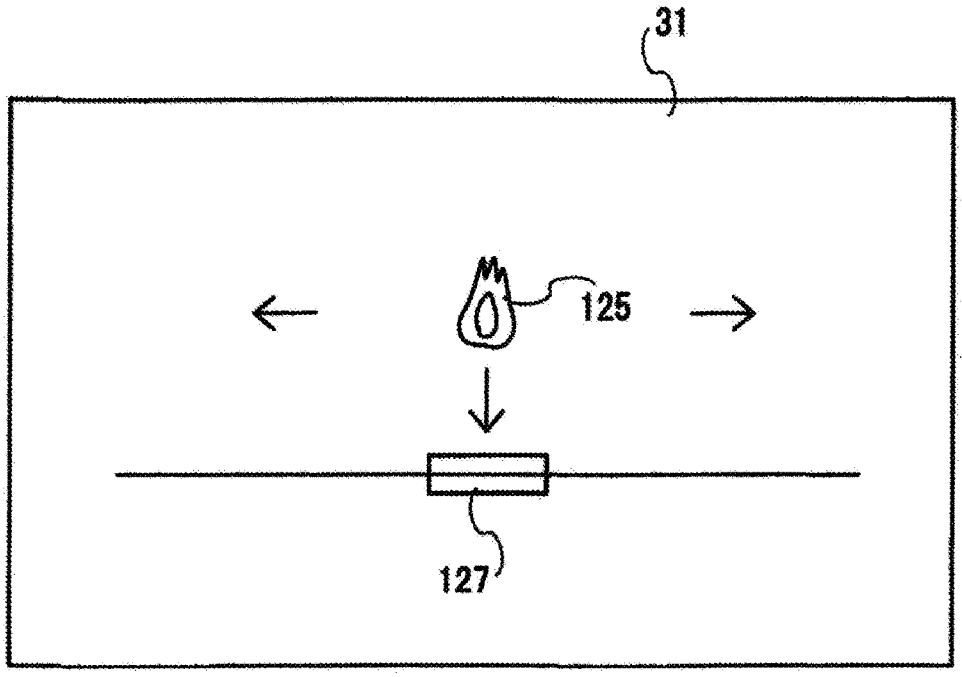

As shown in FIGS. 1 and 13B, in the game machine 20, as another example of this embodiment, the flame character 125 displayed in accordance with music flowing from a speaker or the like falls on the touch monitor 31. If the push button portion 51 is successfully depressed at a position of a depression line 127 with good timing, points are acquired, and the game result is displayed once a predetermined number of points are accumulated.

As described above, in the game machine 20, the player can participate in and enjoy the game by operating the operating device 50.

Example 12

As shown in FIGS. 3 and 14, in the game machine 20, while a game is in progress, a display position of a reel 109*a* or 109*b* on which the background of the display portion 30 (touch monitor 32) and the symbol 90 are displayed is changed.

Figures 14A, 14B:
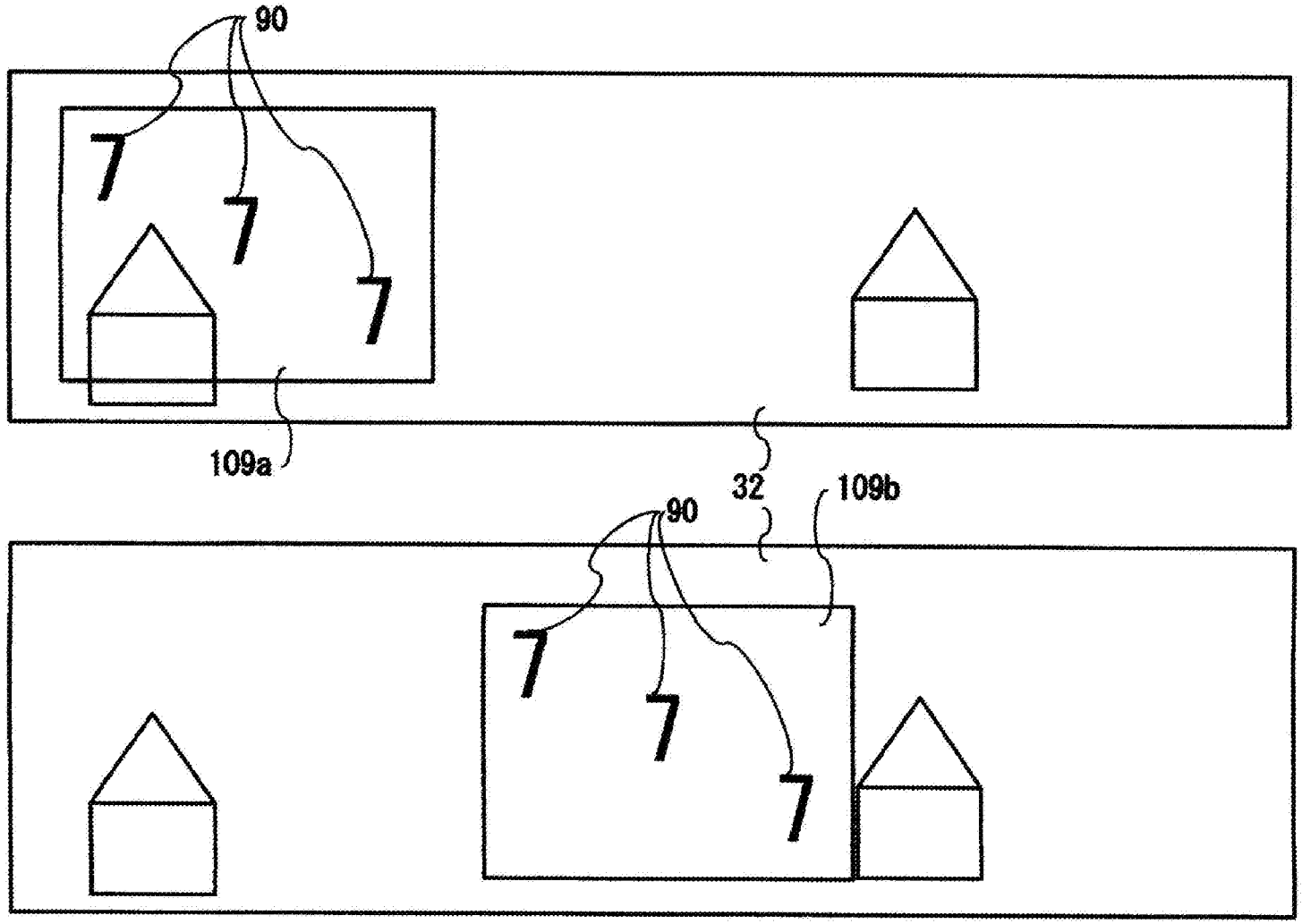
FIGS. 14A and 14B each show a display image of the display portion of the game machine for illustrating Example 12 of the embodiment.

In the game machine 20, when the rotation operation portion 52 of the operating device 50 is rotated, the background or the display position of the reel 109*a* or 109*b* can be changed from FIG. 14A to FIG. 14B.

In the game machine 20, when the rotation operation portion 52 of the operating device 50 is rotated, the display position of the background or the reel 109*a* or 109*b* is changed, and the push button portion 51 is depressed to determine the display position of the background or the reel 109*a* or 109*b*.

Thus, in the game machine 20, the position where the background or the reel 109*a* or 109*b* appears can be changed according to the preference of a player.

Example 13

Next, a performance using the operating device 50 will be described with reference to FIGS. 15A and 15B. Example 13 shows operation of the notifying control portion notifying beforehand that it is advantageous for a player while a game is in progress.

Figure 15A:
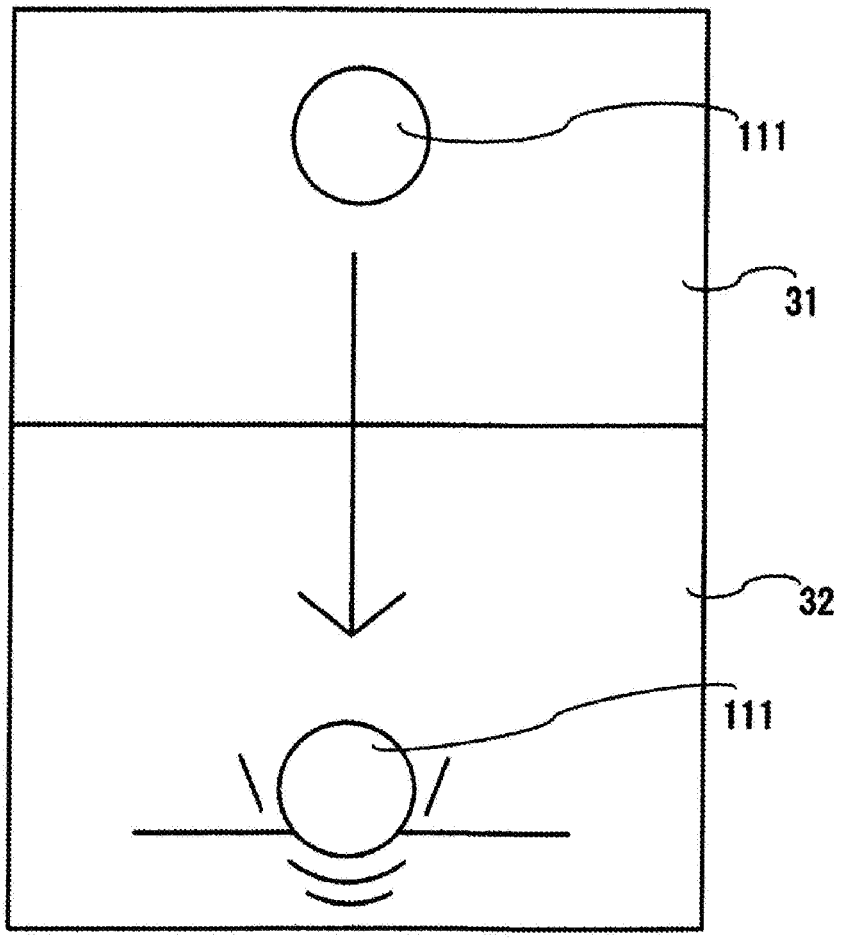
FIGS. 15A and 15B are respectively explanatory views of a display image of the display portion of the game machine and the operating device of the game machine for illustrating Example 13 of the embodiment.

In this example, as shown in FIG. 15A, a falling object 111 such as a stone or a ball falls on the touch monitors 31 and 32 while bridging over the touch monitor 31 and the touch monitor 32. It is indicated that the longer the falling distance, the more advantageous it is for the player.

Figure 15B:
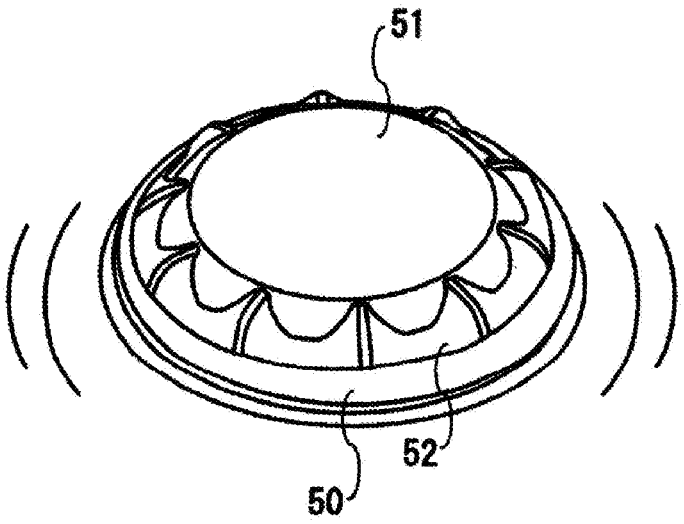

In this display performance, as shown in FIGS. 15A and 15B, when the falling object 111 falls on the ground, the operating device 50 is vibrated by the vibration motor 75 (FIGS. 2 and 4) to notify beforehand that it is advantageous for the player.

Since the vibration of the vibration motor 75 (FIGS. 2 and 4) can be captured when the player is in contact with the operating device 50, notification and information are not given to others but can be given to only the player. Further, since the vibration can be captured when the player is in contact with the operating device 50, the game machine 20 can give the player a feeling as if a meteorite has truly fallen.

Example 14

Figure 16:
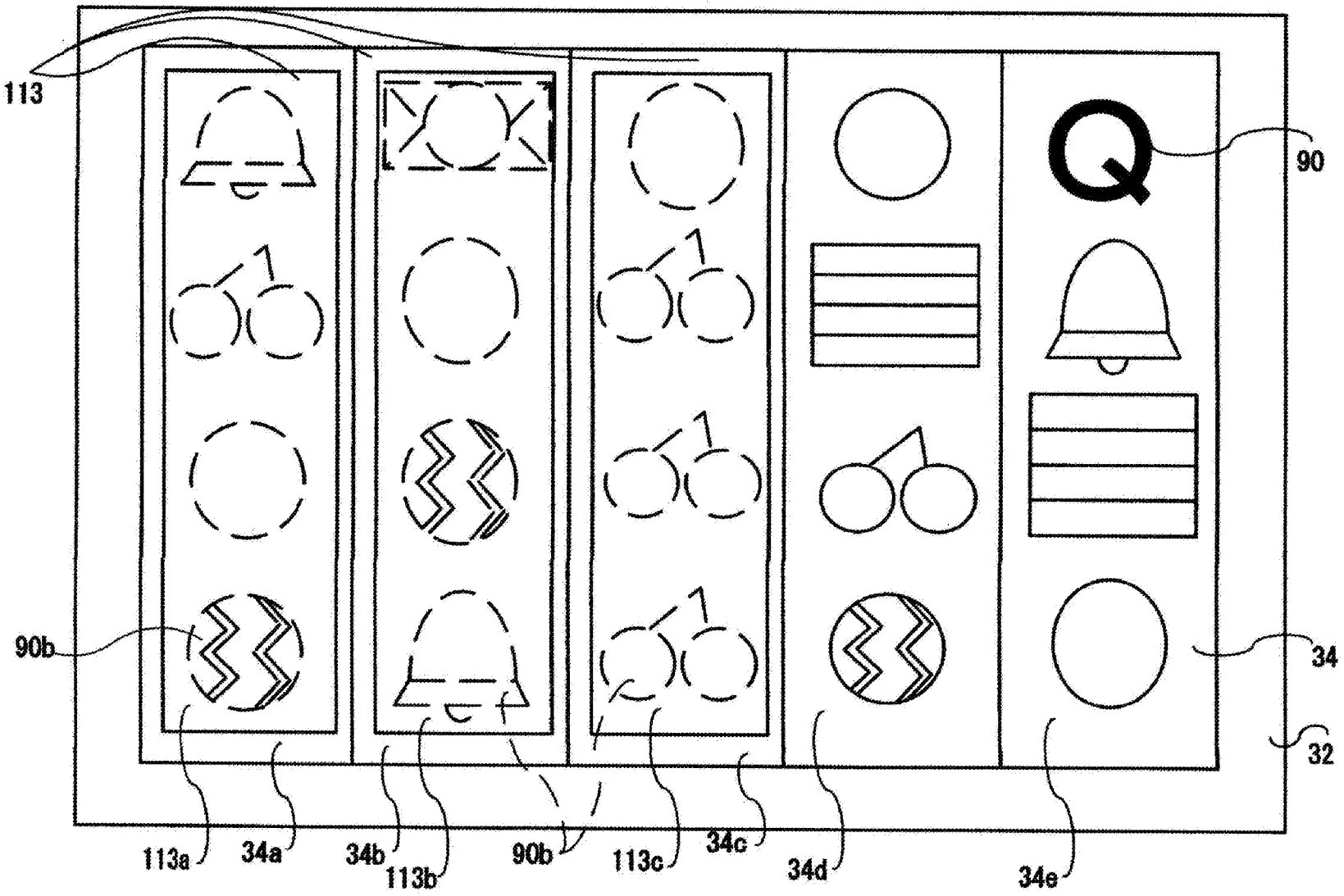
FIG. 16 shows a display image of the display portion of the game machine for illustrating Example 14 of the embodiment.

Next, a performance displayed on the touch monitor 32 will be described with reference to FIG. 16.

The reel 34 displayed on the touch monitor 32 displays the reel 34*e* in order from the left reel 34*a* at the normal time. In the case of a special performance, for example when it is advantageous for a player, a cover portion 113*a* covering the entirety of the left reel 34*a* is provided without displaying the symbol 90*b*. This control is similarly performed for the reels 34*b* and 34*c*, and then the reels 34*d* and 34*e* displaying the symbols 90 are displayed as in the normal state.

Thereafter, the cover portions 113*a*, 113*b*, and 113*c* are removed, and the symbols 90*b* of the reels 34*a*, 34*b*, and 34*c* are displayed in order, or the symbols 90*b* of the reels 34*a*, 34*b*, and 34*c* are displayed simultaneously.

As described above, in the game machine 20, the reel 34 initially displayed at the normal time covers one or a plurality of the reels 34 with the cover portions 113 (113*a*, 113*b*, and 113*c*), so that the player can maintain a sense of expectation for a high payout until the second half.

Example 15

Next, a performance displayed on the touch monitor 32 will be described with reference to FIG. 17.

Figure 17A:
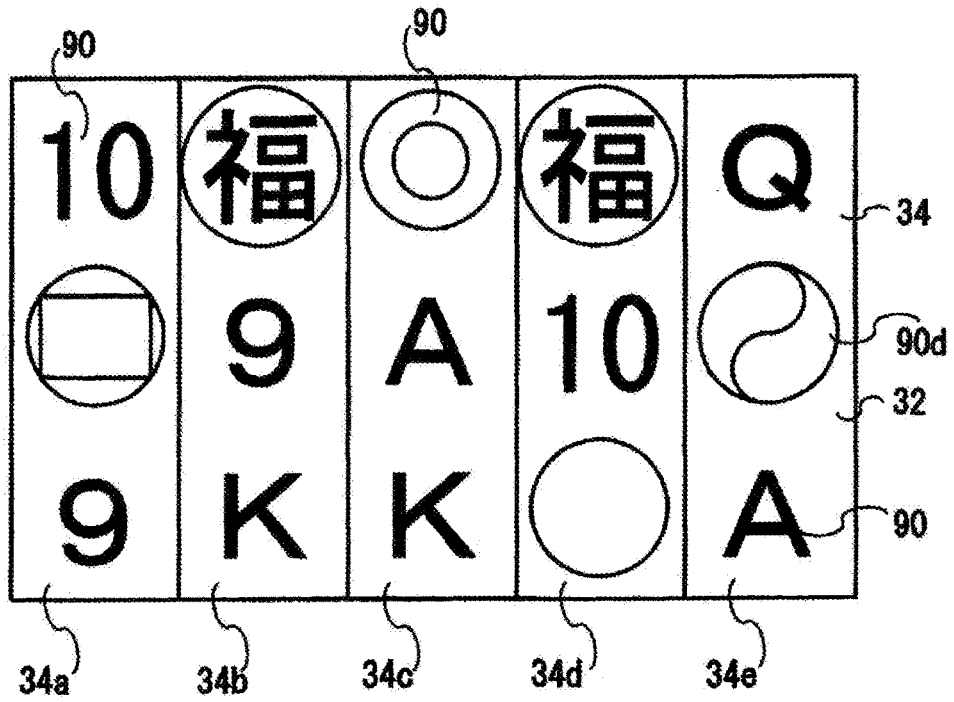
FIGS. 17A and 17B each show a display image of the display portion of the game machine for illustrating Example 15 of the embodiment.

As shown in FIG. 17A, the reel 34 displayed on the touch monitor 32 displays the reel 34*e* in order from the left reel 34*a* at the normal time. When the symbol 90 is converted into a wild symbol 90*d* by lottery, the stop position of the symbol 90 of each of the reels 34 is determined. The wild symbol 90*d* is an almighty symbol that can be applied to any symbol, and is a symbol that is advantageous for a player.

At this time, when a payout occurs, the wild symbol 90*d* converted in advance is displayed, and whether the reel 34*e* is stopped or whether the symbol 90 is converted into the wild symbol 90*d* after the reel 34*e* is stopped is determined by lottery. Then, the reel 34*e* is stopped and displayed in the manner of the above-described content determined by lottery.

If there is no payout, the symbol 90 to be converted is converted in advance into the wild symbol 90*d*, and then the reel 34*e* is stopped. Thus, despite the occurrence of the performance that the symbol 90 is converted, the change of the symbol 90 without a payout can be prevented, and it is possible to improve a sense of expectation of the player for the conversion performance.

Figure 17B:
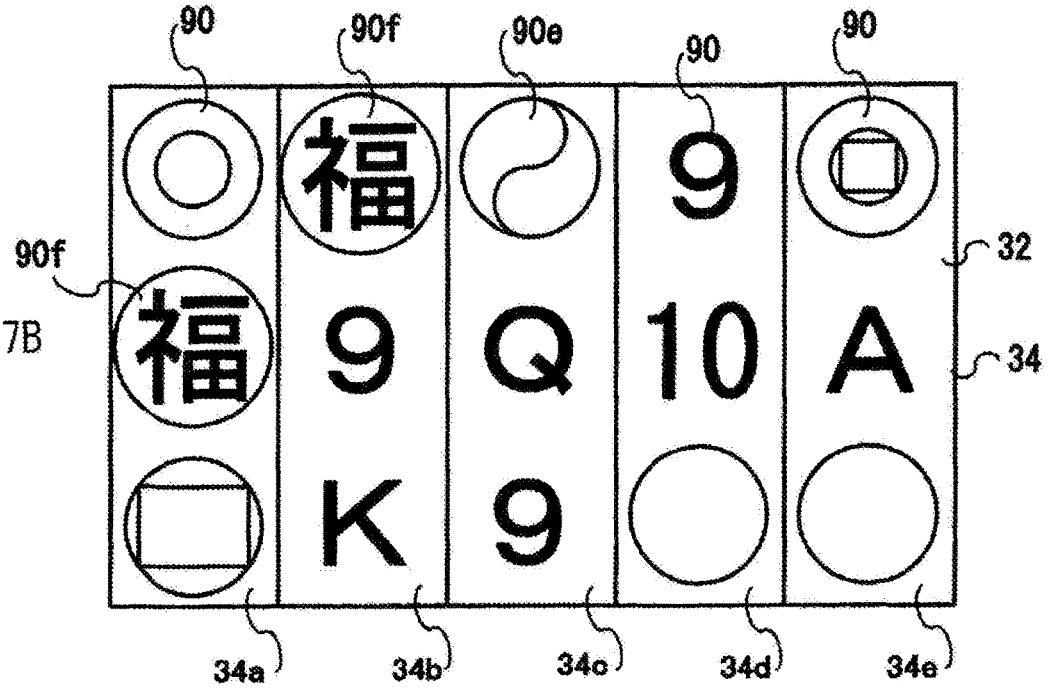

As a modified example of the present embodiment, as shown in FIG. 17B, the reel 34 displayed on the touch monitor 32 displays the reel 34*e* in order from the left reel 34*a* at the normal time. In the game machine 20, when a trigger symbol 90*f* is converted into a wild symbol 90*e* by lottery, the stop position of the symbol 90 of each of the reels 34 is determined.

Here, the trigger symbol 90*f* is a symbol used for determination of winning to a state advantageous for the player, such as a bonus stage or a free game, due to appearance of a predetermined number regardless of a stop line of the symbol 90.

As shown in FIG. 17B, when the trigger symbol 90*f* stops on the first reel 34*a*, on the second and subsequent reels 34 (34*b*, 34*c*, 34*d*, and 34*e*), the trigger symbol 90*f* is converted in advance into the wild symbol 90*e*, and then the reel 34*c* is stopped.

Thus, in this example, it is possible to prevent the performance that, despite the fact that the trigger symbols 90*f* are aligned on the reel 34*c*, conversion into the wild symbols 90*e* is performed, and it is possible to prevent that the trigger symbol 90*f* is forcibly converted to make the player feel distrust.

Example 16

Next, a performance of a free game of the game machine 20 will be described with reference to FIGS. 1 and 18. A free game is a game that can be played a predetermined number of times for free.

For example, as shown in a free game winning table 131 shown in FIG. 18, when a free game 1 (132) and a free game 2 (133) are each selected with a probability of 50%, in the free game 1 (132), a free game A is performed seven times, and in a final free game B134, there is a case where the free game is won at a rate of 50% again.

On the other hand, in the free game 2 (133), the free game A is performed seven times, and in a final free game C135, it is decided at the time of lottery in advance that the free game is won at a rate of 100%.

In the game of the free game A, it is prefetched that the free game is won, and the notifying control portion described above is operated to perform notification so as to give the player a sense of expectation. Examples of the notification include notification due to vibration of the operating device 50, sound notification, and notification which is different from usual and is displayed on the display portion 30.

If the payout amount during the free game is decided, the notifying control portion performs prefetching from a region storing winning contents, and the notifying control portion may be operated to perform notification so as to give the player a sense of expectation. Examples of the notification include notification due to vibration of the operating device 50, sound notification, and notification which is different from usual and is displayed on the display portion 30. Thus, the notification performance according to prefetching can improve the expectation of the player.

As described above, the player can further enjoy the game by using the operating device 50 and participating in the game. However, the present invention is not limited to the above examples, and examples of the method of using the operating device 50 and participating in the game include a method of selecting a hand in a Janken game (i.e., the game of "paper, stone, and scissors") and a method in which like an RPG game, a player operates a character by using the operating device 50 to enjoy the performance. When the character is operated, the push button portion 51 may be pushed continuously in some cases. However, when the push button portion 51 is pressed long for more than 1 second instead of being pushed continuously, a continuous push state may be maintained.

In the above examples, in a case where the rotation operation is prompted during a performance, when the operation of the rotation of the operating device 50 or the depression of the push button portion 51 is not performed for a predetermined time in order to make the progress of the game interesting, the game may be forcibly progressed. For example, the predetermined time is about 10 to 15 seconds, and after taking time to operate, if there is no operation for progressing the game, the game result may be displayed to proceed to the next game.

As described above, the player can enjoy a game with good tempo without wasting time and without being bored.

REFERENCE NUMERALS

20 Game machine
21 Casing portion
22 Emergency LED
23 Power supply board
24 Motherboard
25 I/O board
26 Table
30 Display portion
31, 32 Touch monitor
34, 34*a*, 34*b*, 34*c*, 34*d*, 34*e*, 109*a*, 109*b* Reels
35 Payout display portion
36 Bet display portion
37 Credit amount display portion
41 Bill acceptor
42 Ticket printer
43 Bet button
44 Payout button
45 Spin button
50 Operating device
51 Push button portion
52 Rotation operation portion
53 Body portion
54 Flange portion
55 Rotation shaft
56 Urging means
57 Control board
58 CPU
59*a* Cutout circular arc portion
59*b* Circular arc protruding portion
60 Light source portion
61 LED
62 Shaft
65 Rotation driving portion
66, 66*b*, 67*b* Decoration display portion
67 Rotation fixing portion
68 Ball urging receiver
69 Side light source portion
70 Cable
71 Motor
72 Rotation operation detecting portion
73 Origin detecting portion
74 Jog sensor
75 Vibration motor
76 Button switch
77 LED driver
78 Motor driver
79 USB terminal
84 Transparent cross
85 Cross
86 Light guide portion
90, 90*b* Symbol
90*d*, 90*e* Wild symbol
90*f* Trigger symbol
91 Selection card
92 Sphere
93 Special symbol
94 Change symbol
95 Toss coin
96*a*, 96*b* Card
101 Roulette
102 Ball
105 Wheel
107 Dice
108 Coin
111 Falling object
113, 113*a*, 113*b*, 113*c* Cover portion
114 Partial cover portion
121 Speed display portion
123 Character
125 Flame character
127 Depression line
131 Free game winning table
132 Free game 1
133 Free game 2
134 Free game B
135 Free game C

What is claimed is:

1. An operating device of a game machine, the operating device being installed in the game machine including a display portion which displays the progress of a game in which a reel with a symbol disposed is stopped in accordance with a control of a body controller, and a result of the game, the operating device being configured to operate the progress of the game in conjunction with a display on the display portion, the operating device comprising:

a rotation operation portion capable of being rotated by a player;

a rotation operation detecting portion which detects a state of rotation operation of the rotation operation portion;

a decoration display portion which is located within the rotation operation portion and displays any one of a pattern, a symbol and a letter, or a combination thereof reflected by light from a light-emitting diode (LED) provided in a side light source portion in the decoration display portion, and a lower decoration display portion in contact with the decoration display portion; and a connection portion which outputs a signal of the rotation operation detecting portion to the body controller and inputs a signal for controlling a display of the decoration display portion from the body controller.

2. The operating device of the game machine according to claim 1, further comprising a rotation driving portion which rotates the decoration display portion in conjunction with a display on the display portion.

3. The operating device of the game machine according to claim 1, wherein the rotation operation detecting portion detects a rotation direction or the number of rotations.

4. The operating device of the game machine according to claim 1, wherein the rotation operation portion which selects a display content of the display portion is provided, and wherein the rotation operation portion includes a depression operation portion capable of determining the display content of the display portion by depression by the player.

5. The operating device of the game machine according to claim 1, wherein the connection portion which outputs a signal for changing some of the symbols arranged on the reel stopped and displayed on the display portion in conjunction with operation in which the player rotates the rotation operation portion is provided.

6. The operating device of the game machine according to claim 2, wherein the rotation driving portion capable of changing the rotation direction or rotation speed is provided.

7. The operating device of the game machine according to claim 1, wherein the rotation operation portion of the operating device has circular arc concavoconvex around an outer circumference of the rotation operation portion.

8. The operating device of the game machine according to claim 1, further comprising, above the decoration display portion, a cover portion which covers the decoration display portion, wherein the cover portion includes a transmission portion which has the same shape with the decoration display portion and transmits below and a non-transmission portion which covers the rotation display portion other than the decoration display portion in a non-transmission manner.

9. The operating device of the game machine according to claim 1, further comprising a vibration driving portion which vibrates the rotation operation portion.

10. A game machine installing a display portion which displays the progress of a game in which a reel with a symbol disposed is stopped in accordance with a control of a body controller, and a result of the game and an operating device which operates the progress of the game, wherein the operating device includes:

a rotation operation portion allowing a player to operate rotation in conjunction with a display on the display portion; and a rotation operation detecting portion which detects a state of rotation operation of the rotation operation portion, and the rotation operation portion includes:

a depression operation portion capable of determining a display content of the display portion by depression by the player; and a decoration display portion which displays any one of a pattern, a symbol and a letter, or a combination thereof in conjunction with a display on the display portion, wherein the body controller includes operation software driven by a CPU, and a program driven by the operation software includes an operating device control program that performs a lottery which is advantageous for a player, controls the display portion and the operating device, and performs control such that the operating device and the display portion are interlocked, wherein the operating device control program includes a toss coin notifying control portion which causes the display portion to display a mode of throwing a toss coin upward and informs the result of the game according to a state where the toss coin stops, wherein the toss coin notifying control portion causes the display portion to display that the toss coin is thrown upward with detection of the rotation of the rotation operation portion as a trigger, determines a height of the toss coin moving upward according to the number of rotations or the rotation speed of the rotation operation portion, and displays the state where the toss coin stops when the depression operation portion is depressed after the rotation of the rotation operation portion is detected.

11. The game machine according to claim 10, wherein the display portion includes a payout display portion which displays a state of payout acquired from a result of the game, a mode of displaying the state of payout on the payout display portion is changed according to the number of rotations or the rotation speed of the rotation operation portion.

12. The game machine according to claim 11, wherein the payout display portion includes an earned amount display portion which represents, as a numerical value, an earned amount earned according to the result of the game, and the number of digits of the earned amount display portion is displayed in order from a first digit according to the number of rotations of the rotation operation portion.

13. The game machine according to claim 12, wherein in the earned amount display portion, after the rotation operation portion rotates, all the earned amount is capable of being displayed by depressing the depression operation portion.

14. The game machine according to claim 10, wherein the display portion includes a plurality of selection regions having a predetermined shape, arranged in a circular shape, and displayed in a three-dimensional arrangement state, the selection region is rotated and displayed in conjunction with the rotation of the rotation operation portion, and the game progresses according to a content of the selection region determined by depression operation of the depression operation portion.

15. The game machine according to claim 10, wherein the display portion includes a plurality of selection regions having a predetermined shape and arranged in a matrix, a mark indicating selection of the selection region moves in conjunction with a rotation direction of the rotation operation portion, and the game progresses according to the content of the selection region determined by the depression operation of the depression operation portion.

16. The game machine according to claim 14, wherein the predetermined shape includes any one of a three-dimensional shape, a card shape, a spherical shape and a coin shape.

17. The game machine according to claim 10, wherein in the depression operation portion which determines the progress of the game, depression of the depression operation portion is invalidated unless the rotation of the rotation operation portion is detected, and after the rotation of the rotation operation portion is detected, when the depression operation portion is depressed, the game is progressed.

18. The game machine according to claim 10, wherein the operating device control program includes a notifying control portion which notifies occurrence of setting of a state advantageous for a player with the depression of the depression operation portion as a trigger before the result of the game is displayed on the display portion while the game is in progress.

19. The game machine according to claim 18, wherein the notifying control portion performs notification with vibration of the rotation operation portion.

20. The game machine according to claim 18, wherein the state advantageous for the player is a bonus stage where a payout is expected, payment of a large dividend, high odds, or winning of a free game allowing the game to be played a predetermined number of times for free.

21. The game machine according to claim 18, wherein the notifying control portion performs notification with vibration of the rotation operation portion when a specific symbol by which payment of a large dividend is expected stops.

22. The game machine according to claim 10, wherein in the game in which the game selected by depression progresses with the depression of the depression operation portion as a trigger, when the depression operation portion is not pressed for a predetermined time, the game progresses after a lapse of the predetermined time.

23. The game machine according to claim 10, further comprising a light emitting display portion which is provided below the decoration display portion and emits light in multiple colors with a light source, wherein before the result of the game is displayed on the display portion, displaying is performed on the light emitting display portion, according to the earned amount according to the result of the game or odds, with a plurality of light emission colors different from each other, the different light emission colors are changed at one of predetermined speeds, and after the rotation of the rotation operation portion is detected, when the depression operation portion is depressed, suggestion for payment is performed with the light emission color according to the earned amount earned according to the result of the game or the odds.

24. The game machine according to claim 23, wherein, when payment of a large dividend occurs or high odds occur, the number of the light emission colors displayed on the light emitting display portion is reduced as compared to payment of a small dividend or low odds, and the light emission color is changed.

25. The game machine according to claim 10, wherein the toss coin notifying control portion causes the display portion to display that the toss coin is thrown upward with detection of the rotation of the rotation operation portion as a trigger, determines a rotation speed of the toss coin when the toss coin moves upward according to the number of rotations or the rotation speed of the rotation operation portion, and displays the state where the toss coin stops when the depression operation portion is depressed after the rotation of the rotation operation portion is detected.

26. The game machine according to claim 10, wherein an expectation degree of the result of the game changes according to the height of the toss coin moving upward.

27. The game machine according to claim 25, wherein an expectation degree of the result of the game changes according to the rotation speed of the toss coin.

28. The game machine according to claim 10, wherein the display portion includes a plurality of reels including a plurality of symbols, and among the symbols stopped in the reel, when a special symbol is stopped, a mode of changing to a symbol in which the earned amount increases as compared to a result in which the special symbol is stopped is changed in conjunction with the rotation of the rotation operation portion.

29. The game machine according to claim 10, wherein the display portion includes a gauge display portion, and the gauge display portion displays a level of the rotation speed of the rotation operation portion.

30. The game machine according to claim 10, wherein the operating device control program changes a position where the reel of the display portion is displayed or a background image of the display portion in conjunction with the rotation of the rotation operation portion.

31. The game machine according to claim 10, wherein the operating device control program includes an earned coin display controller which displays, on the display portion, a mode of paying out pseudo payout coins in accordance with the earned amount, and the earned coin display controller changes and displays the number of the payout coins to be paid out in conjunction with the number of rotations or the rotation speed of the rotation operation portion.

32. The game machine according to claim 10, wherein the display portion includes the plurality of reels including the plurality of symbols, and the display portion displays first the reel which covers the plurality of symbols such that the symbols are not displayed by using a partial cover portion, then displays a predetermined one of the symbols on the reel on which the plurality of symbols are displayed on the partial cover portion, and then after a predetermined amount of time displays the symbol of the reel which covers the plurality of symbols such that the symbols are not displayed by using a partial cover portion.

33. The game machine according to claim 10, wherein when a state advantageous for the player is shifted to a normal game, a display of the plurality of reels on which the plurality of symbols displayed in the game immediately preceding a current game are displayed is deleted, and the plurality of predetermined reels on which the plurality of predetermined symbols are displayed are replaced and displayed.

34. The game machine according to claim 10, wherein when a state advantageous for the player is set, variation in interval between the reels is started in an order different from usual.

35. The game machine according to claim 10, wherein in a case where each of the reels starts to vary in interval between the reels, when a state advantageous for the player is expected, the interval at which each of the reels starts to vary is made different from usual.

36. The game machine according to claim 10, wherein in a case where each of the reels starts to vary in interval between the reels, when a state advantageous for the player is expected, an interval at which one of the reels starts to vary is made different from an interval at which the other reels start to vary.

37. The game machine according to claim 10, wherein in a case where a special symbol is converted into a wild symbol that allows substitution for all symbols relating to winning as a state advantageous for the player, when a trigger symbol with which when a predetermined number of the trigger symbols appear on the first reel regardless of a winning line, the state advantageous for the player is won is stopped, the second and subsequent reels are not converted into the wild symbols, after the trigger symbol is converted in advance into the wild symbol on the reel, the reel is stopped, and when the trigger symbol is not stopped on the first reel, the second and subsequent reels convert the special symbol into the wild symbol after the reel is stopped.

38. The game machine according to claim 11, wherein when a special symbol is converted into a wild symbol, whether or not benefit of the game occurs due to conversion into the wild symbol is determined, when the benefit of the game does not occur, after the trigger symbol is converted in advance into the wild symbol on the reel, the reel is stopped, and when the benefit of the game occurs, whether the reel is stopped after the trigger symbol is converted in advance into the wild symbol on the reel or whether the special symbol is converted into the wild symbol after the reel is stopped is determined by lottery, and the symbol of the reel is determined based on either one of the lotteries.

39. The game machine according to claim 22, wherein when the free game is won, all lotteries in the free game are performed in advance, a benefit or the number of games is stored, and the display portion or the operating device informs occurrence of setting of the state advantageous for the player based on the results of the lotteries performed in advance before the number of games are consumed while the game is in progress.

40. The game machine according to claim 20, wherein when the free game is won, all lotteries in the free game are performed in advance, a benefit determined by lottery or the number of games is stored, and the display portion or the operating device informs a result of the benefit determined by lottery in any of the plurality of consecutive free games.

* * * * *